US010109146B2

(12) United States Patent
Nam

(10) Patent No.: US 10,109,146 B2
(45) Date of Patent: Oct. 23, 2018

(54) PROBABILISTIC VENDING MACHINE, AND DRIVING APPARATUS AND METHOD THEREOF

(71) Applicant: Hwawoo Nam, Seoul (KR)

(72) Inventor: Hwawoo Nam, Seoul (KR)

( * ) Notice: Subject to any disclaimer, the term of this patent is extended or adjusted under 35 U.S.C. 154(b) by 495 days.

(21) Appl. No.: 14/758,240

(22) PCT Filed: Mar. 13, 2014

(86) PCT No.: PCT/KR2014/002149

§ 371 (c)(1),
(2) Date: Jun. 28, 2015

(87) PCT Pub. No.: WO2014/196727

PCT Pub. Date: Dec. 11, 2014

(65) Prior Publication Data

US 2016/0086424 A1 Mar. 24, 2016

(30) Foreign Application Priority Data

Jun. 4, 2013 (KR) ..... 10-2013-0064092

(51) Int. Cl.
*G07F 17/32* (2006.01)
*G07F 7/00* (2006.01)
*G07F 17/34* (2006.01)

(52) U.S. Cl.
CPC ..... *G07F 17/3213* (2013.01); *G07F 7/00* (2013.01); *G07F 17/3202* (2013.01); *G07F 17/34* (2013.01)

(58) Field of Classification Search
CPC .. G07F 17/32; G07F 17/3213; G07F 17/3202; G07F 17/34; A63F 5/00; A63F 5/04; A63F 5/043
USPC ..... 221/24
See application file for complete search history.

(56) References Cited

U.S. PATENT DOCUMENTS 5,096,196 A * 3/1992 Gutknecht ..... A63F 5/0094 273/142 HA
5,553,851 A * 9/1996 Malavazos ..... A63F 5/02 273/115
5,584,763 A * 12/1996 Kelly ..... A63F 5/04 273/139
6,105,962 A 8/2000 Malavazos et al.
6,988,731 B2 * 1/2006 Inoue ..... G07F 17/3211 273/138.2
7,878,506 B1 2/2011 Kelly et al.
2003/0178768 A1 * 9/2003 Luciano ..... A63F 5/00 273/142 HA

FOREIGN PATENT DOCUMENTS

KR 20-1996-0005858 Y1 7/1996
KR 10-1998-0039979 A 8/1998
KR 10-2012-0131880 A 12/2012

* cited by examiner

*Primary Examiner* — Timothy R Waggoner
(74) *Attorney, Agent, or Firm* — Drinker Biddle & Reath LLP

(57) ABSTRACT

A probabilistic vending machine includes: a rotary shaft state sensing unit sensing an operation state of a rotary shaft and outputting a signal of a corresponding state; a control unit connected with the rotary shaft state sensing unit; a gear control motor connected to the control unit; and a rotary shaft deceleration motor connected to the control unit.

34 Claims, 16 Drawing Sheets

PROBABILISTIC VENDING MACHINE, AND DRIVING APPARATUS AND METHOD THEREOF

FIELD

The present disclosure relates to a probabilistic vending machine, and driving apparatus and method thereof.

BACKGROUND

In general, vending machines simply dispense an article when a user puts coins or paper money for paying for the article into it, and have nothing specifically enjoyable to attract the interest of users who are purchasers of the items.

So, users do not use the vending machines for fun or out of interest, unless the vending machines have articles that the users desire.

Unlike these vending machines, there are game machines wherein when a user pays a predetermined fee, the game machines may provide an article more economically valuable than the fee or may provide a predetermined number of articles exceeding an expected number of articles.

However, according to these game machines, users have to wait until the game machines output the final result, after they put money into the game machines as much as the predetermined fees.

Accordingly, users do not play any role in the operation of the game machines, so if the game machines output results that are not the results desired by the user, the user loses interest, and accordingly, the user may use the game machines less or may apply a physical force to the game machines.

As a result, the profits of the manufacturers of the game machines are reduced and the game machines may be damaged.

SUMMARY

An object of the present disclosure is to further arouse users' interest.

A probabilistic vending machine according to an embodiment of the present disclosure comprises: a fixed shaft having an empty space in a center and extending in a first direction; a fixed plate connected with the fixed shaft and having a stopper; a driving gear connected with the fixed shaft; a driving plate connected with the driving gear and rotating in a first rotational direction or a second rotational direction opposite to the first rotational direction; a first transfer gear connected with the driving gear; a driving shaft connected with the first transfer gear; a rotary shaft disposed in the empty space of the fixed shaft and extending in the first direction; a rotary plate connected with rotary shaft; a second transfer gear connected to the driving shaft; a third transfer gear connected to the rotary shaft to correspond to the second transfer gear; a gear control mechanism moving the driving shaft in the first direction; and a rotary shaft deceleration mechanism reducing a rotational speed of the rotary shaft.

A probabilistic vending machine according to another embodiment of the present disclosure comprises: a first fixed shaft being a hollow shaft and extending in a first direction; a driving gear connected with the first fixed shaft; a driving plate connected with the driving gear and rotating in a first rotational direction or a second rotational direction opposite to the first rotational direction; a rotary shaft being a hollow shaft, disposed inside the first fixed shaft, and extending in the first direction; a rotary plate connected with the rotary shaft; a second fixed shaft disposed inside the rotary plate and extending in the first direction; a fixed plate connected to the second fixed shaft and having a stopper; a first transfer gear connected with the driving gear; a driving shaft connected with the first transfer gear; a second transfer gear connected to the driving shaft; a third transfer gear connected to the rotary shaft to correspond to the second transfer gear; a gear control mechanism moving the driving shaft in the first direction; and a rotary shaft deceleration mechanism reducing a rotational speed of the rotary shaft.

A probabilistic vending machine according to another embodiment of the present disclosure comprises: a driving plate rotating in a first rotational direction or a second rotational direction opposite to the first rotational direction; a fixed shaft having an empty space in a center and extending in a first direction; a driving gear connected with the driving shaft; a fixed shaft extending in the first direction in the empty space of the driving shaft; a rotary shaft disposed in an empty space of the fixed shaft and extending in the first direction; a rotary plate connected with rotary shaft; a fixed plate disposed on the fixed shaft and having a stopper; a first gear connected with the driving shaft; a second gear engaging with the first gear or disengaging from the first gear by moving in the first direction; a third gear engaged with the second gear and connected with the rotary shaft; a gear control mechanism moving the second gear in the first direction; and a rotary shaft deceleration mechanism reducing a rotational speed of the rotary shaft.

The gear control mechanism may comprise a gear control motor that rotates, and is moved straight in the first direction by operation of the gear control motor.

The rotary shaft deceleration device may comprise a rotary shaft deceleration motor that rotates and a power transmission mechanism connected to the rotary shaft and transmits torque from the rotary shaft deceleration motor to the rotary shaft.

The probabilistic vending machine may further comprise a plurality of supports spaced from each other in the first direction and supporting positions of the fixed shaft, the driving shaft, and the rotary shaft by passing through at least one of the fixed shaft, the driving shaft, and the rotary shaft.

The probabilistic vending machine may further comprise a shield disposed on the fixed plate and covering the rotary plate.

The probabilistic vending machine may further comprise a shield disposed on the driving plate and covering the driving plate. The probabilistic vending machine may further comprise a plurality of supports spaced from each other in the first direction and supporting positions of the first and second fixed shafts, the driving shaft, and the rotary shaft by passing through at least one of the first and second fixed shaft, the driving shaft, and the rotary shaft.

The probabilistic vending machine may further comprise a shield disposed on the fixed plate and covering the rotary plate.

A driving device of a probabilistic vending machine according to another aspect of the present disclosure comprises: a rotary shaft state sensing unit sensing an operation state of a rotary shaft and outputting a signal showing a corresponding state; a control unit connected with the rotary shaft state sensing unit; a gear control motor connected to the control unit; and a rotary shaft deceleration motor connected to the control unit, in which when a rotational speed of the rotary shaft determined on the basis of a rotary shaft state sensing signal outputted from the rotary shaft state sensing unit is a second setup speed or more, the control unit disengages a driving shaft and a rotary shaft from each other by operating the gear control motor, and when the rotational speed of the rotary shaft determined on the basis of a rotary shaft state sensing signal outputted from the rotary shaft state sensing unit is a third setup speed or more, the control unit controls deceleration state of the rotary shaft deceleration motor, using a current stopper position, a final stop section of the stopper, and a final stop state of the stopper.

The final stop section and the final stop state of the stopper may be determined in accordance with the number of driving times of the probabilistic vending machine.

The control unit may perform deceleration control with a predetermined deceleration degree of the rotary shaft motor in accordance with a change of the rotational speed of the rotary shaft.

When the rotational speed of the rotary shaft determined on the basis of the rotary shaft state sensing signal outputted from the rotary shaft state sensing unit is a first setup speed or more, the control unit may determine whether or not the rotational speed of the rotary shaft determined on the basis of a rotary shaft state sensing signal outputted from the rotary shaft state sensing unit is a second setup speed or more.

When the rotational speed of the rotary shaft determined on the basis of the rotary shaft state sensing signal outputted from the rotary shaft state sensing unit is a first setup speed or more, the control unit may increase the number of driving times by '1', and when the increased number of driving times is less than a setup number of driving times, the control unit may determine whether or not the rotational speed of the rotary shaft determined on the basis of a rotary shaft state sensing signal outputted from the rotary shaft state sensing unit is a second setup speed or more.

When the rotational speed of the rotary shaft determined on the basis of the rotary shaft state sensing signal outputted from the rotary shaft state sensing unit less than a first setup speed, the control unit may increase the number of rotation times of a driving plate by '1', and when the increased number of rotation times of the driving shaft is a setup number of times or more, the control unit may restrict a current user using the probabilistic vending machine.

When the number of rotation times of the rotary shaft is a setup number of times or more, the control unit may disengage the driving shaft and the rotary shaft from each other by operating the gear control motor.

The driving device may further comprise a money sensing unit sensing whether money has been put into a slot and outputting a signal showing a corresponding state, in which the control unit may determine via the money sensing unit whether a predetermined amount of money has been put into the slot through, and when the money sensing unit senses the predetermined amount of money put in the slot, the control unit may engage the rotary shaft and the driving shaft with each other by operating the gear control motor.

The driving device may further comprise a driving shaft state sensing unit sensing an operation state of the driving shaft and outputting a signal showing a corresponding state, in which when a speed of the driving shaft determined on the basis of a driving shaft state sensing signal outputted from the driving shaft state sensing unit is in a stop state, the control unit may engage the rotary shaft and the driving shaft with each other by operating the gear control motor.

When the rotational speed of the rotary shaft determined on the basis of the rotary shaft state sensing signal outputted from the rotary shaft state sensing unit is a first setup speed or more, the control unit may increase an accumulated amount of money by a one-time fee and keeps the increased amount of money in a storage.

The driving device may further comprise: a communication unit communicating with a user terminal and a management server; and a cash box locking device connected with the control unit and controlling a locking state of a cash box in the probabilistic vending machine. The control unit may perform identification with the user terminal, and when the identification is finished, the control unit may transmit the accumulated amount of money to a management server through the user terminal by transmitting the accumulated money for a fee to the user terminal through the communication unit, and unlock the cash box locking device.

A method of driving a probabilistic vending machine according to another embodiment of the present disclosure comprises: determining whether a rotational speed of a rotary shaft is a second setup speed or more on the basis of a signal outputted from a rotary shaft state sensing unit; disengaging a driving shaft and the rotary shaft from each other by operating a gear control motor, when the rotational speed of the rotary shaft is the second setup speed or more; determining whether the rotational speed of the rotary shaft is a third setup speed or more on the basis of a signal outputted from the rotary shaft state sensing unit; determining the number of driving times of a probabilistic vending machine, using data kept in a storage, when the rotational speed of the rotary shaft is the third setup speed or more; determining a final stop section and a final stop state of a stopper corresponding to the determined number of driving times; and positioning the stopper to the final stop section in the final step state by reducing the rotational speed of the rotary shaft at a predetermined deceleration degree by operating a rotary shaft deceleration motor on the basis of the rotational speed of the rotary shaft.

The method may further comprise: determining money put into a slot on the basis of a signal outputted from a money sensing unit; determining whether the money put in the slot is the same as a setup amount of money; determining whether the driving shaft is in a stop state on the basis of a driving shaft state sensing signal, when the money put in the slot is the same as the setup amount of money; and engaging the driving shaft with the rotary shaft by operating a gear control motor, when the driving shaft is in a stop state.

The method may further comprise: determining whether time that has elapsed after money has been put in a slot exceeds a setup time, when the money put in the slot is not the same as a setup amount of money; and discharging the money, which has been put in the slot, through the slot when the time elapsed exceeds the setup time.

The method may further comprise: determining whether the rotational speed of the rotary shaft is a first setup speed or more on the basis of a signal outputted from a rotary shaft state sensing unit; and proceeding to determining whether the rotational speed of the rotary shaft is the second setup speed or more, after increasing the number of driving times of the probabilistic vending machine by '1' when the speed of the driving shaft is the first setup speed or more.

The method may further comprise: increasing the number of rotation times of a driving plate by '1', when the rotational speed of the rotary shaft is less tan the first setup speed; determining whether the number of rotation times of the driving plate is the same as a setup number of times; and discharging a money put in a slot to the slot, when the number of rotation times of the driving plate is the same as the setup number of times.

The method may further comprise: determining whether the speed of the rotary shaft is the first setup speed or more on the basis of a signal outputted from the rotary shaft state sensing unit; and increasing the accumulated amount of money by a one-time fee, when the speed of the rotary shaft is the first setup speed or more.

The method may further comprise: performing identification with a user terminal; transmitting information about the accumulated amount of money for a fee to the identified user terminal; storing a record of taking out cash and then initializing the accumulated amount of money, after transmitting the information about the accumulated amount of money; and unlocking a cash box after transmitting the information about the accumulated amount of money.

According to these features, when a predetermined speed is reached, a driving shaft and a rotary shaft are disengaged and deceleration of a rotary plate is performed regardless of a driving plate, so user interest is increased.

Further, since the final stop section of a stopper is set in accordance with the number of driving times of a driving plate, a manager can control an average product allocation state. Therefore, both a user and a manager can use the probabilistic vending machine without a large economic loss, so satisfaction of both the user and the manager can be increased.

BRIEF DESCRIPTION OF THE DRAWINGS

FIG. 14 shows the stopper in a stopper-vertical section, and FIG. 15 shows the stopper in a stopper-inclined section.

DETAILED DESCRIPTION

Figure 1:
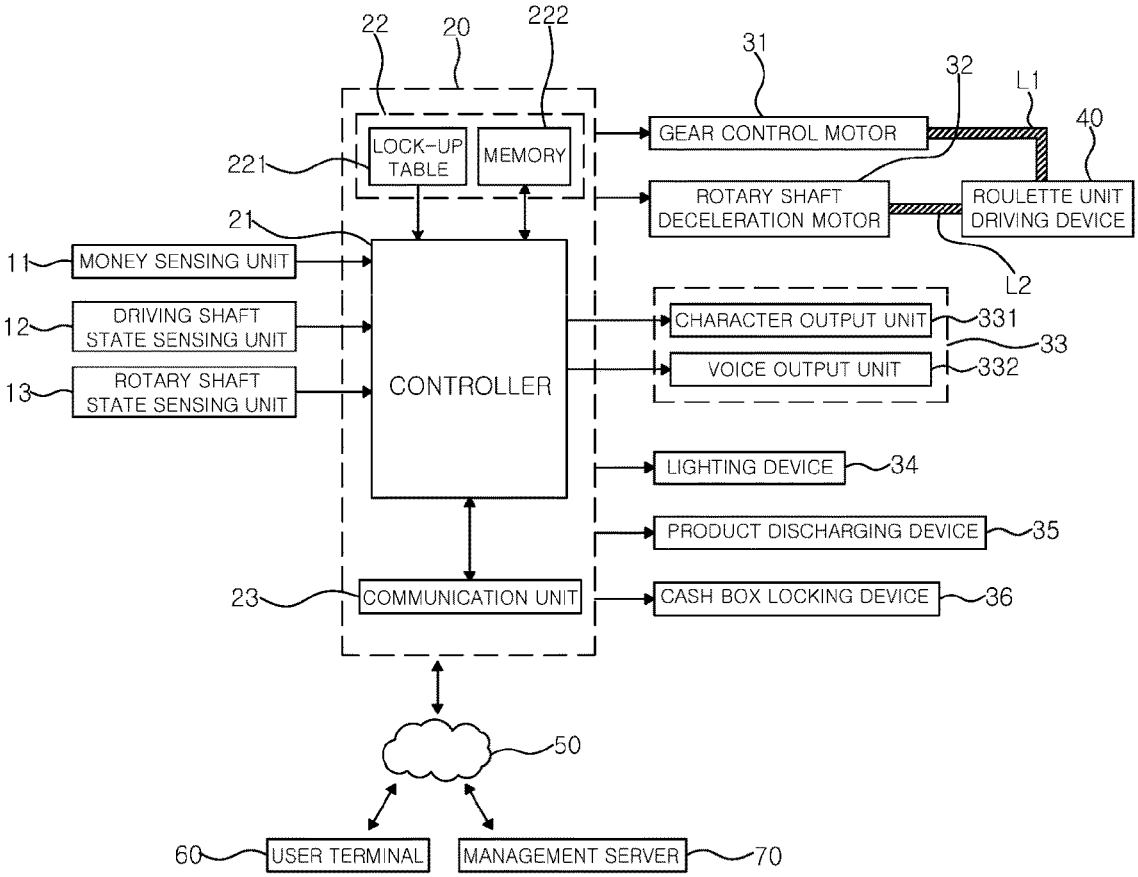
FIG. 1 is a schematic block diagram of a probabilistic vending machine according to an embodiment of the present disclosure.

Hereinafter, exemplary embodiments of the present disclosure will be described in detail with reference to the accompanying drawings for those skilled in the art to be able to easily accomplish the present disclosure. However, the present disclosure may be achieved in various different ways and is not limited to the embodiments described herein. In the accompanying drawings, portions not related to the description will be omitted in order to obviously describe the present disclosure, and similar reference numerals will be used to describe similar portions throughout the present specification.

Hereinafter, a probabilistic vending machine according to an embodiment of the present disclosure, and an apparatus and method of driving the probabilistic vending machine, are described with reference to the accompanying drawings.

In this embodiment, the probabilistic vending machine includes a roulette unit driving device that is a driving mechanism of the probabilistic vending machine.

Referring to FIGS. 1 to 8, a probabilistic vending machine according to an embodiment comprises: a money sensing unit 11; a driving shaft state sensing unit 12; a rotary shaft state sensing unit 13; a control unit 20 connected to the money sensing unit 11, the driving shaft state sensing unit 12, and the rotary shaft state sensing unit 13; a gear control motor 31 connected to the control unit 20 and changing operation in response to signals from the control unit 20; a rotary shaft deceleration motor 32 connected to the control unit 20 and changing operation in response to signals from the control unit 20; a message output device 33 connected to the control unit 20 and changing operation in response to signals from the control unit 20; a lighting device 34 connected to the control unit 20 and changing operate in response to signals from the control unit 20; a product discharging device 35 connected to the control unit 20 and changing operation in response to signals from the control unit 20; a cash box locking device 36 connected to the control unit 20 and changing operation in response to signals from the control unit 20; a roulette unit driving device 40 connected to the gear control motor 31 and the rotary shaft deceleration motor 32 through a driving shaft L1 and a rotary shaft L2, respectively; and a user terminal 60 and a management server 70 communicating with the control unit 20 through a communication network 50.

The money sensing unit 11 is disposed around a slot 111, and senses whether money is put into the slot 111 and outputs a signal showing a corresponding state.

Figure 8:
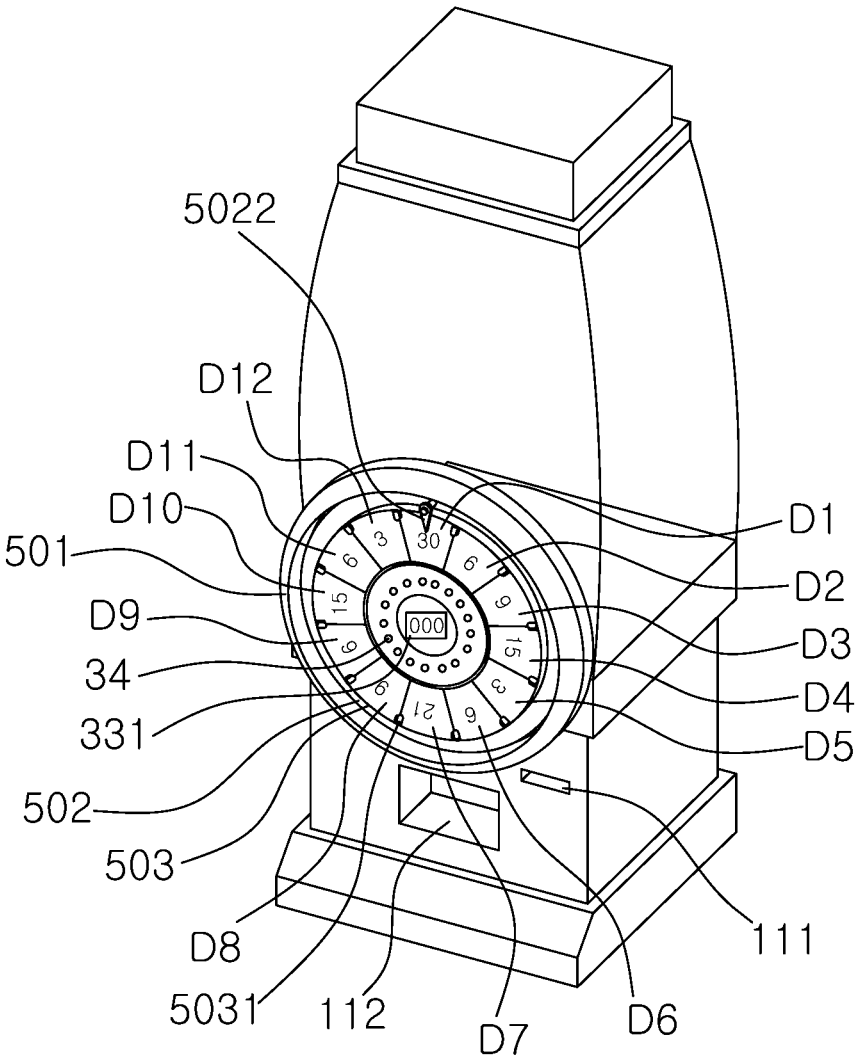
FIG. 8 is a schematic perspective view of a probabilistic vending machine according to an embodiment.

In FIG. 8, the slot 111 according to this embodiment is a slit for putting cash such as a coin or paper money and the money sensing unit 11 senses whether cash is put into the machine.

Alternatively, the probabilistic vending machine according to this embodiment may additionally have a card slot instead of or other than the slot 111 for putting cash into the machine, in which the money sensing unit 11 can sense whether a card such as a credit card or a check card, instead of or in addition to cash, is inserted into the machine.

The driving shaft state sensing unit 12 is disposed on a support 5052 connected with a driving shaft L2 or another support 5053, senses whether the driving shaft L1 stops or rotates, and outputs a signal showing a corresponding state.

The driving shaft state sensing unit 12 may be a photosensing unit having a light emitting unit and a light receiving unit, but it may not be provided, if not necessary.

The rotary shaft state sensing unit 13 is disposed on a rotary shaft L2 and outputs signals corresponding to the rotational direction, rotational speed, and the position of the rotary shaft 12.

The rotary shaft state sensing unit 13 may be a rotary encoder or an absolute rotary position sensor (that is, a stationary rotational position sensor) that outputs pulse signals corresponding to the operation states of the rotary shaft L2.

The rotary shaft state sensing unit 13 outputs a predetermined number of pulses when the rotary shaft L2 makes a turns, so it changes the number of pulses outputted per second, depending on the rotational speed, and can determine the position of the rotary shaft, using the number of pulses generated from a rotation start time point, that is, every rotation start pulse generation time point in order to determine the state in every turn.

Further, it can determine whether the rotary shaft L2 rotates in a forward direction (for example, clockwise) or a backward direction (for example, counterclockwise), using the shapes of generated pulses.

The control unit 24 comprises a controller 21 connected with the sensing units 11 to 13, a storage 22 connected with the controller 21, and a communication unit 23 connected with the controller 21 and communicating with the communication network 50.

The controller 21 determines the operational state of the probabilistic vending machine on the basis of signals from the sensing units 11 to 13 and outputs control signals for controlling the probabilistic vending machine to the motors 31 and 32 and the units 33 to 36 disposed behind it, thereby controlling the probabilistic vending machine, that is, the operation of the roulette unit driving device.

That is, the controller 21 controls the gear control motor 31 on the basis of the sensing signals from the money sensing unit 11 and the driving shaft state sensing unit 12.

Further, the controller 21 controls the operation of the rotary shaft deceleration motor 32 on the basis of sensing signals from the rotary shaft state sensing unit 13.

Further, the controller 21 controls the operation of the message output device 33, the lighting device 34, and the product discharging device 35 in accordance with the operational state of the probabilistic vending machine, and controls the operational state of the cash box locking device 36 by determining whether money is put in the cash box or not.

The storage 22 includes a look-up table 221 keeping the final stop area and the final stop state of the probabilistic vending machine that are set on the basis of the numbers of operation times of the probabilistic vending machine which are ordinal numbers, and a memory 222 keeping a deceleration control profile for controlling deceleration operation of the rotary shaft deceleration motor 32 of the probabilistic vending machine.

The memory 22 also keeps data about the operational states of the probabilistic vending machine, for example, the number of operation times of the probabilistic vending machine, the number of rotation times of a driving plate 501 after one-time fee is received, and the accumulated money for the fee according to the number of driving times.

The communication unit 23 connected with the controller 21 transmits data (for example, identification data) created by the controller 21 to the outside, or receives data from the outside and transmits it to the controller 21.

The communication unit 23 performs a non-contact smart card interface (ISO-14443 type A or B) using wireless communication such as Bluetooth or Wi-Fi or local communication such as NFC (near field communication). The communication unit 23 is disposed in the control unit 20 in FIG. 1, but it may be disposed outside the control unit 20.

The gear control motor 31 and the rotary shaft deceleration motor 32 are controlled in rotational state in accordance with signals from the controller 21 and they may be servo motors.

The message output device 33 comprises a character output unit 331 and a voice output unit 332 that output characters and voices conveying messages corresponding to operation of the controller 21. In this embodiment, the characters may comprise at least one of symbols and numbers.

The character output unit 331 may be an LCD (liquid crystal display) or an OLED (organic light emitting display) and the voice output unit 332 may be a speaker.

The light device 34 is controlled to be turned on or off by the controller 21 and may be composed of a plurality of LEDs (light emitting diode).

The product discharging device 35 is controlled to discharge a predetermined number of products to a product exit 112. Unlike this embodiment, when a manager of the probabilistic vending machine separately gives a product selected by roulette operation to a user, the product discharging device 35 may not be provided.

The cash box locking device 36 locks or unlocks the cash box (not shown) in response to signals from the controller 21.

The communication network 50 may be implemented by a wireless communication network of a mobile communication provider such as 3G (3 generation) or LTE (long term evolution), a wireless internet network, or a non-contact smart card interface type based on 13.56 MHz.

The user terminal 60, which is a portable terminal such as a smartphone, communicates with the communication unit 23 of the control unit 20 through the communication network 50 and transmits the amount of accumulated money, which is information about the sales to the portable terminal 60 through interactive identification. The amount of accumulated money is transmitted to the user terminal 60 from the controller 21.

The management server 70, which is a server managing operation of the probabilistic vending machine, has a database (not shown).

The management server 70 receives the amount of accumulate money in the game machine at a predetermined place from the user terminal 60 through the communication network 50 and records it in the database, before the cash box locking device 360 is opened.

Next, the structure of the roulette driving mechanism 40 is described with reference to FIGS. 2 to 7.

First, an example of the roulette driving mechanism 40 is described with reference to FIGS. 2 to 3.

The roulette driving mechanism 40 according to this embodiment comprises: a driving plate 501 having an opening substantially at the center portion; a fixed plate 502 spaced forward from the driving plate 501; a rotary plate 503 spaced forward from the fixed plate 502; a shield 504 made of a transparent material, disposed on the fixed plate 502, and protecting the rotary plate 503; a hollow fixed shaft L3 substantially connected to the center portion of the fixed plate 501 and extending in a first direction (for example, X direction) through the opened center portion of the driving shaft 501; a rotary shaft L2 connected to substantially the center portion of the rotary plate 503, disposed inside the hollow fixed shaft L3, and extending in the first direction along the fixed shaft L3; a driving gear G1 disposed around the inner edge that is the edge of the opening at the center portion of the driving plate 501; a first transfer gear G2 engaged with the driving gear G1; a driving shaft L1 connected with the first transfer gear G2; a second transfer gear G3 connected with the driving shaft L1; a third transfer gear G4 engaged with or disengaged from the second transfer gear G3 and connected with the rotary shaft L2; a plurality of supports 5051~5053 spaced from each other and arranged in series in the first direction; a gear control mechanism 506 controlling engagement and disengagement of the second transfer gear G3 and the third transfer gear G4; a rotary shaft deceleration mechanism 507 controlling deceleration of the rotary shaft L2; and a plurality of bearings B1~B6 disposed between a rotary member and a fixed member, such as between the fixed shaft L3 and the driving gear G1, between the driving shaft L1 and the supports 5051 and 5052, between the support 5053 and the rotary shaft L2, between the support 5052 and the fixed shaft L3, and between the fixed plate 502 and the rotary shaft L2.

The gear control mechanism 506 comprises: a gear control motor 31; a moving pin 5061 inserted in the support 5053 and moved straight forward or backward in the first direction X by a force applied by the gear control motor 31; a moving plate 5062 disposed between the moving pin 5061 passing through the support 5053 and being in contact with the moving pin 5061 and the second transfer gear G3; a spring 5063 disposed between the support 5053 and the moving pin 5061; and a spring 5064 fitted on the driving shaft L1 and disposed between a stopping plate 5065 and the second transfer gear G3.

The stopping plate 5065 is fixed on the driving shaft L1 between the support 5052 and the second transfer gear G3.

The rotary shaft deceleration mechanism 507 comprises; a rotary shaft deceleration motor 32 fixed on the support 5051; a shaft 5072 connected with the rotary shaft deceleration motor 32; a belt connector 5073 fixed on the rotary shaft L2; and a belt 5074 wound around the rotary shaft 5072 and the belt connector 5073. The shaft 5072, belt connector 5073, and belt 5074 constitute a power transmission mechanism for transmitting torque of the motor 32 to the rotary shaft L2.

The driving plate 501, as described above, has an opening empty space at the center portion and has a substantially circular shape.

A protruding part 5011 that protrudes forward from the driving plate 501 is formed around the outer edge of the driving plate 501 which is opposite to the inner edge.

The driving plate 5011 is formed in a flat donut shape and has a flat part 5012 and the protruding part 5011 protruding at the outer edge of the flat part 5012 along the outer edge.

The driving plate 501 is rotated clockwise or counterclockwise by a user.

The fixed plate 502 fixed to the fixed shaft L3, which is a flat part having a flat circular shape, has a diameter smaller than that of the flat part 5012 of the driving plate 501.

The fixed plate 502 overlaps, in the first direction, and the flat part 5012 of the driving plate 501 disposed behind it inside the flat part 5012.

A locking rod 5021 protruding forward from the fixed plate 501 and a stopper 5022 at an end of the locking rod 5021 are disposed at the upper portion of the fixed plate 502.

The locking rod 5021 may have various cross-sectional shapes such as a circle or a rectangle and extends beyond the rotary plate 503 disposed ahead of the fixed plate 502.

The stopper 5022 faces the ground and is rotatably coupled to the locking rod 5021.

The rotary plate 503 can be rotated by the rotary shaft L2 and has a plurality of divided sections D1~Dn on the front side, that is, the side opposite to the side closer to the fixed plate 502, and details such as products, a dividend rate, and the allocated number of articles are written in the sections D1~Dn.

Section separation pins 5031 are disposed at the upper ends of the boundary lines between the sections D1~Dn. As the positions of the section separation pins 5031 are changed by rotation of the rotary plate 503, the section separation pins 5031 hit against and slide over the stopper 5022.

When the rotary plate 503 gradually decelerates and stops, the stopper 5022 stops in one of the sections D1~Dn and indicates a product to be given to a user.

The number of the sections D1~Dn is changed, if necessary, and for example, the sections may be divided into twelve or thirty-two sections.

The numbers of particles to be discharged are written in the sections D1~Dn in FIG. 8, but as described above, product names or dividend rates may be written.

The supports 5051~5055 comprise a first support 5051 that are disposed behind the driving plate 501 and through which the driving shaft L1, the rotary shaft L2, and the fixed shaft L3 pass, a second support 5052 that is disposed behind the first support 5051, through which the driving shaft L1 and the rotary shaft L2 pass, and that is connected with the fixed shaft L3, and a third support 5053 that is disposed behind the second support 5052 and through which the moving pin 5061 passes.

The supports 5051~5055 support the corresponding shafts L1~L3, which pass through them or are connected with them, to hold the shafts L1~L3 in position.

The driving gear G1 is fixed to the driving shaft 501, so as the driving shaft 501 rotates, the driving gear G1 rotates accordingly.

In this process, the fixed shaft L3 is not rotated, because the bearing B1 is disposed between the driving gear G1 and the fixed shaft L3.

Since the first transfer gear G2 is in mesh with the driving gear G1, when the driving gear G1 rotates, the first transfer gear G2 also rotates. The rotation of the first transfer gear G2 by the driving gear G1 is controlled in accordance with the gear ratio of the driving gear G1 and the first transfer gear G2.

The driving shaft L1 connected with the first transfer gear G2 is also rotated by the torque from the first transfer gear G2.

Even though the driving shaft L1 rotates, the torque from the driving shaft L1 is not transmitted to the supports 5051 and 5052 by the bearings B2 and B3.

When the second transfer gear G3 and the third transfer gear G4 are in mesh by the gear control mechanism 506, torque from the driving shaft L1 is transmitted to the third transfer gear G4 and the rotary shaft L2 connected with the third transfer gear G4 is rotated accordingly. The rotation of the third transfer gear G4 is controlled on the basis of a gear ratio of the second and third transfer gears G3 and G4.

The rotary plate 503 is rotated by rotation of the rotary shaft L2.

Even though the rotary shaft L2 rotates, torque is not transmitted to the supports 5053 and 5052 by the bearings B4 and B5, so the supports 5053 and 5052 are not moved. Further, torque from the rotary shaft L2 is not transmitted to the fixed plate 502 by the bearing B6, so the fixed plate 502 stably maintains the fixed state.

In this embodiment, the driving shaft state sensing unit 12, which is a sensor that senses the operation state of the second transfer gear G3 coupled to the driving shaft L1, outputs different signals, depending on whether the second transfer gear G3 and the third transfer gear G4 are engaged or not.

Next, another example of the roulette unit driving mechanism is described with reference to FIG. 4. As compared with FIGS. 2 to 3, components having the same functions are indicated by the same reference numerals and detailed description of them is not provided.

Figure 2:
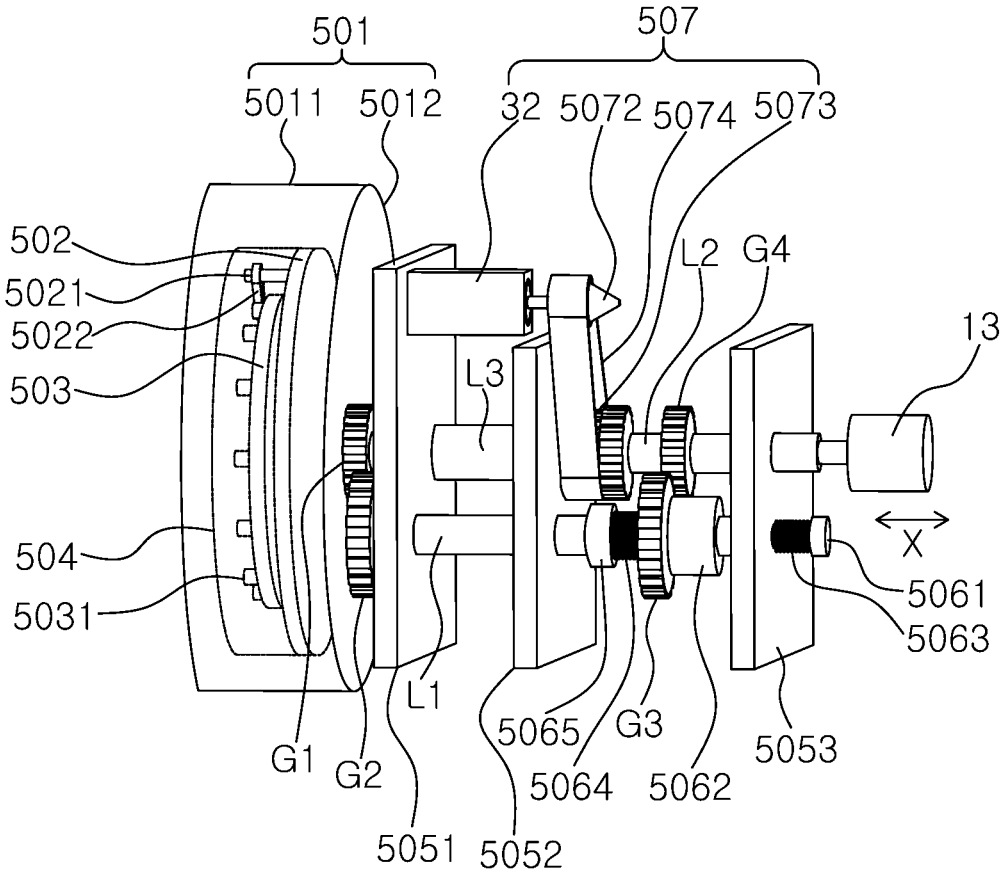
FIG. 2 is a schematic perspective view of an example of a roulette unit driving device of a probabilistic vending machine according to an embodiment.
Figure 3:
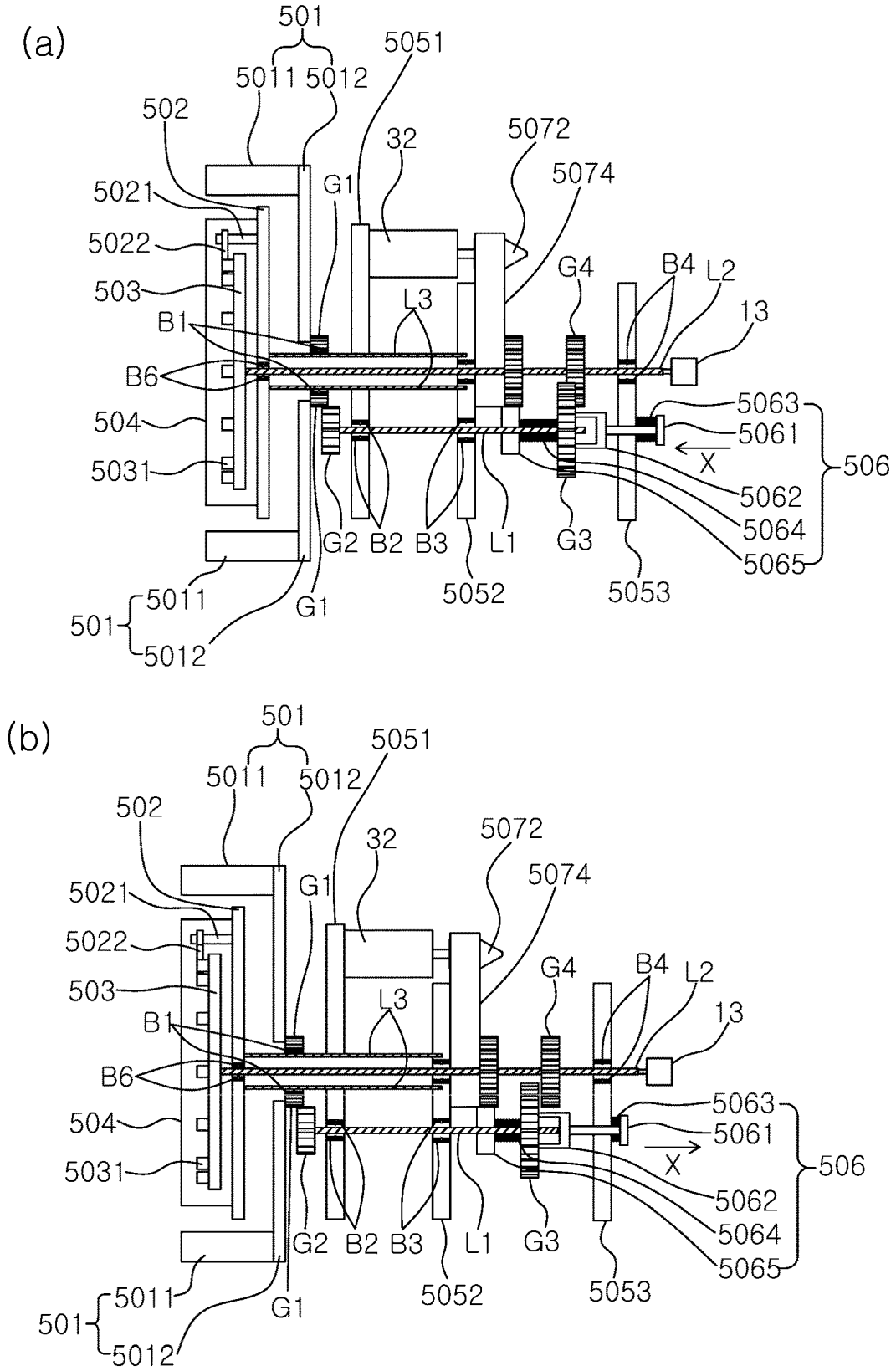
FIGS. 3(*a*) and (*b*) are cross-sectional views of the roulette unit driving device shown in FIG. 2, in which (a) shows a case when a driving shaft and a rotary shaft have been engaged and (b) shows a case when the driving shaft and the rotary shaft have been separated.
Figure 4:
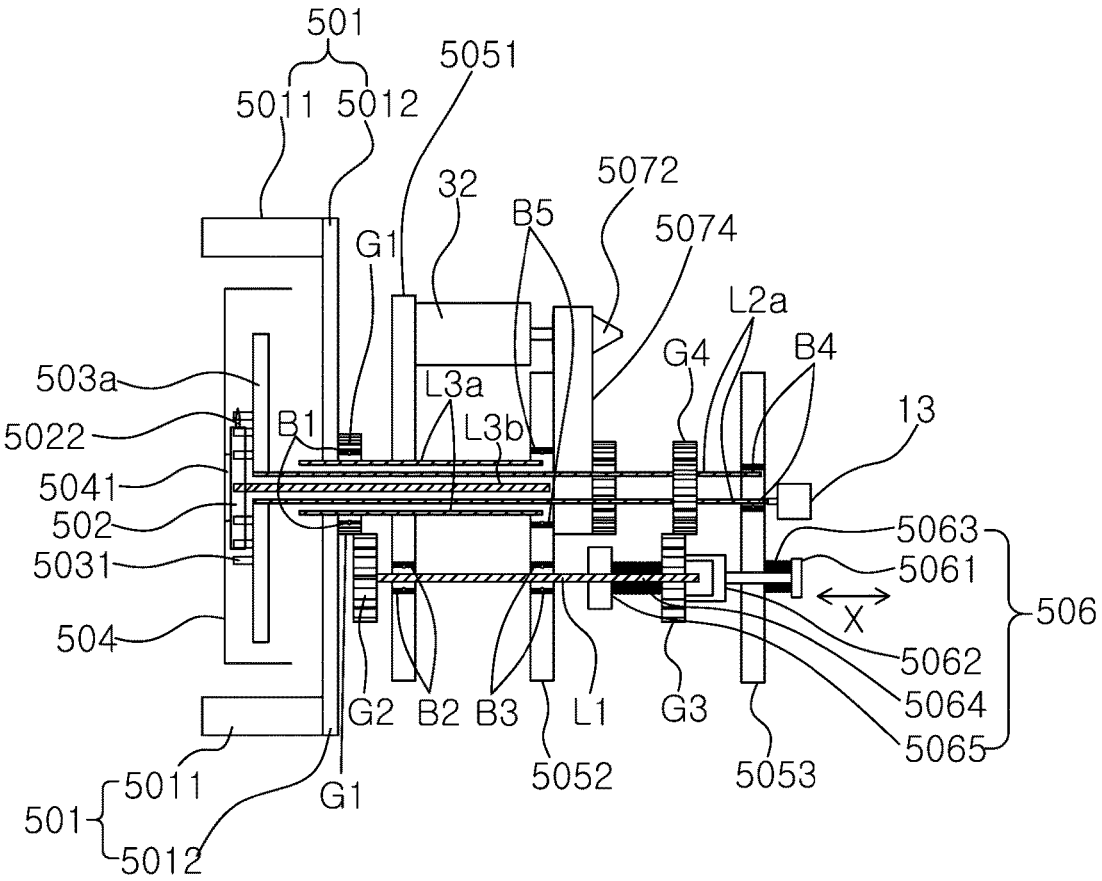
FIG. 4 is a schematic cross-sectional view of another example of a roulette unit driving device of a probabilistic vending machine according to an embodiment.

A roulette unit driving device 501 shown in FIG. 4 has the same structure as the roulette unit driving device shown in FIGS. 2 and 3, except for structures and connection relationships of a driving plate 501, a fixed plate 502*a*, a rotary plate 503*a*, a shield 504, a rotary shaft L2*a*, and fixed shafts L3*a* and L3*b*.

Although a belt connector 5073 of a rotary shaft deceleration mechanism 507 is not shown in FIG. 4, as described above, the rotary shaft deceleration mechanism 507 has the same structure as that shown in FIG. 2, so it includes the belt connector 5073.

In this embodiment, a driving plate 501 has a flat part 5012, a protruding part 5011, and a hole at the center portion.

The rotary plate 503*a* spaced forward from the driving plate 501 and the center portion of the rotary plate 503*a* is also open to correspond to the hole of the driving plate 501. The rotary plate 503*a*, as described above, has a plurality of divided sections D1~Dn and section separation pins 5031 separating the sections are provided.

In this embodiment, the fixed plate 502*a* is disposed ahead of the rotary plate 503*a* and a stopper 5022 is disposed on the rotary plate 503*a*. The stopper 5022 is fixed to the upper portion of the fixed plate 502*a* by an elastic member (not shown) such as a spring and extending toward the section separation pins 5031.

The stopper 5022 overlaps the section separation pins 5031, so when the rotary plate 503*a* rotates, the section separation pins 5031 hit against and slide over the stopper 5022. As described above, since the stopper 5022 is fixed to the fixed plate 502*a* by the elastic member, when it hits against the section separation pins 5031, the shock is small, so damage or breaking of the stopper is largely reduced.

The shield 504 is attached to the fixed plate 502*a* through a connecting portion 5041 and covers the front sides of the fixed plate 502*a* and the fixed plate 503*a*.

The rotary plate 503*a* is larger in diameter than the fixed plate 502*a*, so the entire fixed plate 502*a* overlaps the rotary plate 503*a*.

The first fixed shaft L3*a* is a hollow shaft and connected with the driving plate 501 through the hole of the driving plate 501.

The rotary shaft L2 is also a hollow shaft, and is disposed inside the first fixed plate L3*a* and connected with the rotary plate 503*a* through the hole of the rotary plate 503*a*.

The second fixed plate L3*b* is disposed inside the rotary shaft L2*a* and connected with the fixed plate 502*a*.

The first fixed plate L3*a* extends to a support 5052, which is disposed behind a support 5051, through the support 5051. A driving gear G1 is fixed on the first fixed shaft L3*a*.

The rotary shaft L2*a* extends to a support 5053 sequentially through the supports 5051 and 5052 from the rotary plate 503*a* and is connected with the support 5053*a*.

A third transfer gear G4 that is engaged with or disengaged from t second transfer gear G3 fixed to the driving shaft L1 is fixed on the rotary shaft L2.

The second fixed shaft L3*b* is disposed inside the rotary shaft L2*a* and extends to the support 5052 from the fixed plate 502*a*, so it is connected to the support 5052 through the driving plate 501 and the support 5051.

In this embodiment, the supports 5051~5055 comprise the first support 5051 that is disposed behind the driving plate 501 and through which the driving shaft L1*a*, the rotary shaft L2*a*, and the first and second fixed shafts L3*a* and L3*b* pass, a second support 5052 that is disposed behind the first support 5051, through which the driving shaft L1 and the rotary shaft L2*a* pass, and that is connected the first fixed shaft L3*a*, and a third support 5053 that is disposed behind the second support 5052 and in which a portion of the rotary shaft L2*a* is inserted and coupled.

The supports 5051~5055 support the corresponding shafts L1, L2, L3*a*, and L3, which pass through them or are connected with them, to hold the shafts L1, L2, L3*a*, and L3 in position.

The operation of the roulette unit driving device having this structure is similar to the operation of the roulette unit driving device shown in FIGS. 2 to 3.

That is, when the driving plate 501 rotates and the driving shaft 501 is rotated by the driving gear G1, the rotary shaft L2 is rotated by the second transfer gear G3 and the third transfer gear G3 engaged with each other, and the rotary plate 503*a* is rotated.

The second fixed shaft L3*b* is disposed inside the rotary shaft L2*a* and spaced from the rotary shaft L2*a*, and is also disposed inside the first fixed shaft L3*a* and spaced from the first fixed shaft L3*a*, so even if the rotary shaft L2*a* rotates, the first and second fixed shafts L3*a* and L3*b* maintain the fixed position without rotating.

Even if the rotary plate 503*a* is rotated by rotation of the rotary shaft L2*a*, the fixed plate 502*a* connected to the second fixed shaft L3*b* maintain the fixed position without rotating.

The second and third transfer gears G3 and G4 are in mesh in FIG. 4 and engagement and disengagement of the second and third transfer gears G3 and G4 are the same as them made by the gear control mechanism 506 described above with reference to FIGS. 2 to 3, so it is not described.

Figure 5:
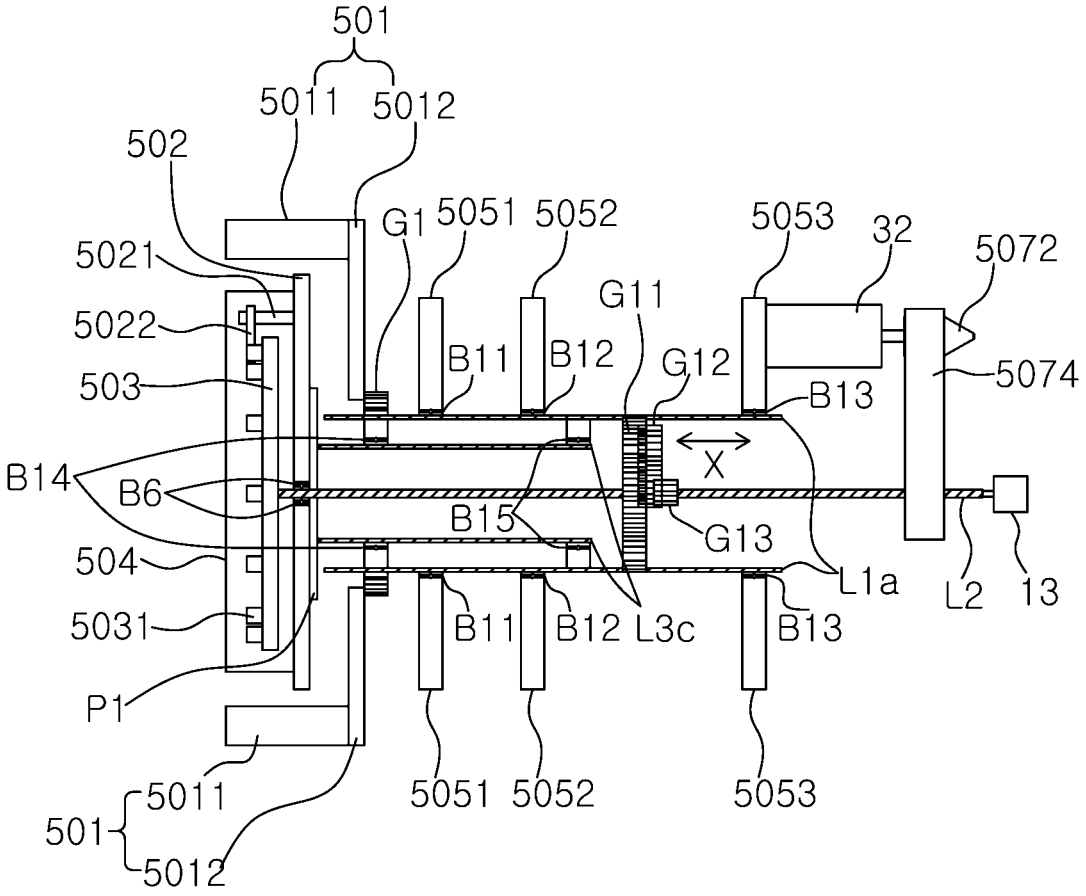
FIG. 5 is a schematic cross-sectional view of another example of a roulette unit driving device of a probabilistic vending machine according to an embodiment.
Figure 6:
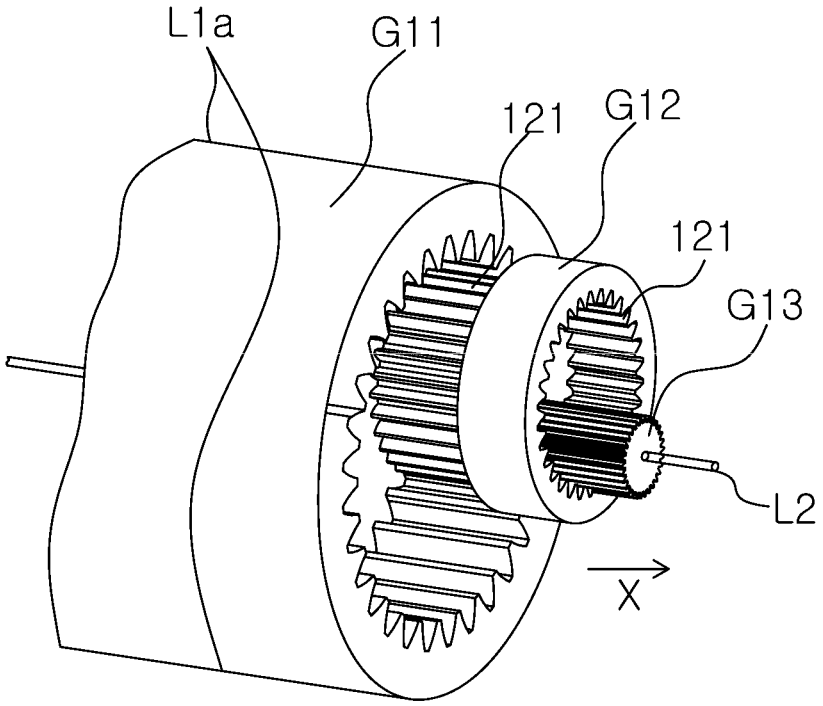
FIG. 6 is a view showing the structures of the gears shown in FIG. 5, in which the gears are engaged.
Figure 7:
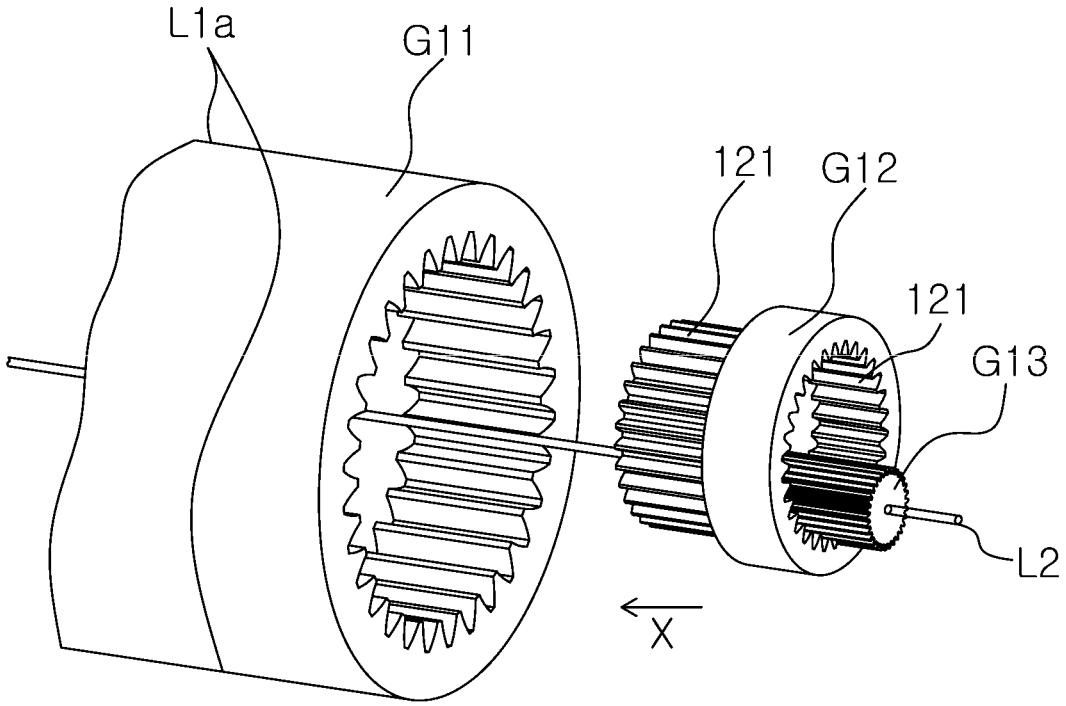
FIG. 7 is a view showing the structures of the gears shown in FIG. 5, in which the gears are disengaged.

As compared with FIGS. 2 to 3, components having the same functions are indicated by the same reference numerals also in FIGS. 5 to 7 and detailed description of them is not provided.

In the roulette unit driving device shown in FIGS. 5 to 7, the structures of a driving plate 501, a fixed plate 502, a rotary plate 503, and a shield 504 are the same as those shown in FIGS. 2 to 3, and there is also provided a plurality of supports 5051~5053 supporting the roulette unit driving device.

However, as shown in FIGS. 5 to 7, the driving plate 501 is connected to a hollow rotary shaft L1*a* and a plurality of gears G11~G13 is sequentially disposed on an end portion of the hollow rotary shaft L1*a*.

The hollow rotary shaft L1*a* corresponds to the driving shaft L1, but it is a hollow shaft different from the driving shaft L1. A driving shaft state sensing unit 12 is connected to the hollow rotary shaft L1*a*, senses the operation state of the rotary hollow shaft L1*a*, and outputs a sensing signal.

Further, in the roulette unit driving device according to this embodiment, as in FIGS. 2 to 3, a hollow fixed shaft L3*c* is disposed in the rotary hollow shaft L1*a* and a rotary shaft L2 connected with the rotary plate 503 extends into the fixed shaft L3*c*. The fixed plate 502 is connected to the fixed shaft L3*c* through a plate P1.

Further, a gear G1 transmitting torque from the driving plate 501 to the rotary hollow shaft L1*a* is disposed between the hollow rotary plate L1*a* and the driving shaft 501 and a rotary shaft state sensing unit 13 is disposed on the rotary shaft L2.

Further, a rotary shaft deceleration mechanism 507 comprising a rotary shaft deceleration motor 31, a shaft 5072, a belt connector 5073, and a belt 5074 is also connected to the rotary shaft L2.

The structure of a plurality of gears G11~G13 is shown in FIGS. 6 and 7.

That is, the gear G11 is formed integrally with the hollow rotary shaft L1*a* by forming teeth on the inner side of an end portion of the hollow rotary shaft L1*a*, so when the rotary plate 501 rotates, torque from the driving shaft 501 is transmitted to the hollow rotary shaft L1*a* through the gear L1 and the gear G11 is rotated accordingly. The gear G11 is an internal gear.

The gear G12 has a first part 121 having teeth on the outer side and a second part 121 having teeth on the inner side and is connected to the gear control motor 31, so when the gear control motor 31 operates, it moves in a first direction X.

When the gear G12 is moved left by operation of the gear control motor 31, as shown in FIG. 6, the first part 121 engages with the gear G11 and torque from the gear 11 is transmitted.

However, when the gear G12 is moved right by operation of the gear control motor 31, as shown in FIG. 7, the gear G12 moves right and disengages from the gear G11 and the torque transmitted through the gear 11 is not transmitted to the gear G12.

The gear G12 is disposed at a predetermined portion by a connecting shaft (not shown) in the roulette unit driving device.

Further, the gear G13 is disposed inside the gear G12 in mesh with the gear G12. When the gear G12 moves in the first direction x, the gear G12 moves in the direction.

Since the gear G13 is connected to the rotary shaft L2, torque from the gear G11 transmitted through the gear G12 is transmitted to the rotary shaft L2. That is, torque from the driving shaft 501 is transmitted to the rotary shaft L2.

When the gear G12 is in mesh with the gear G11, the rotary shaft L2 rotates, and when the gears G12 and G11 are disengaged, torque from the rotary plate 501 is not transmitted to the rotary shaft L2.

Further, in FIG. 5, there is further provided a shield 504*a* attached to the driving plate 501 to cover the driving plate 501, disposed ahead of the driving plate 501, and covering the entire surfaces of the rotary plate 503 and the fixed plate 502. The shield 504*a*, similar to the shield 504 described above, is made of a transparent material.

The rotary plate 503 and the fixed plate 502 are further protected by the shield 504*a*, thereby preventing the roulette game machine from external shock or dirt.

The shield 504*a* can be applied to the probabilistic vending machine shown in FIGS. 2 to 3 and at least one of the two shields 504 and 504*a* may not be provided.

In FIG. 5, reference numerals 'B6' and 'B11~B15' indicate bearings disposed between fixed shafts and rotary shafts.

Figure 9:
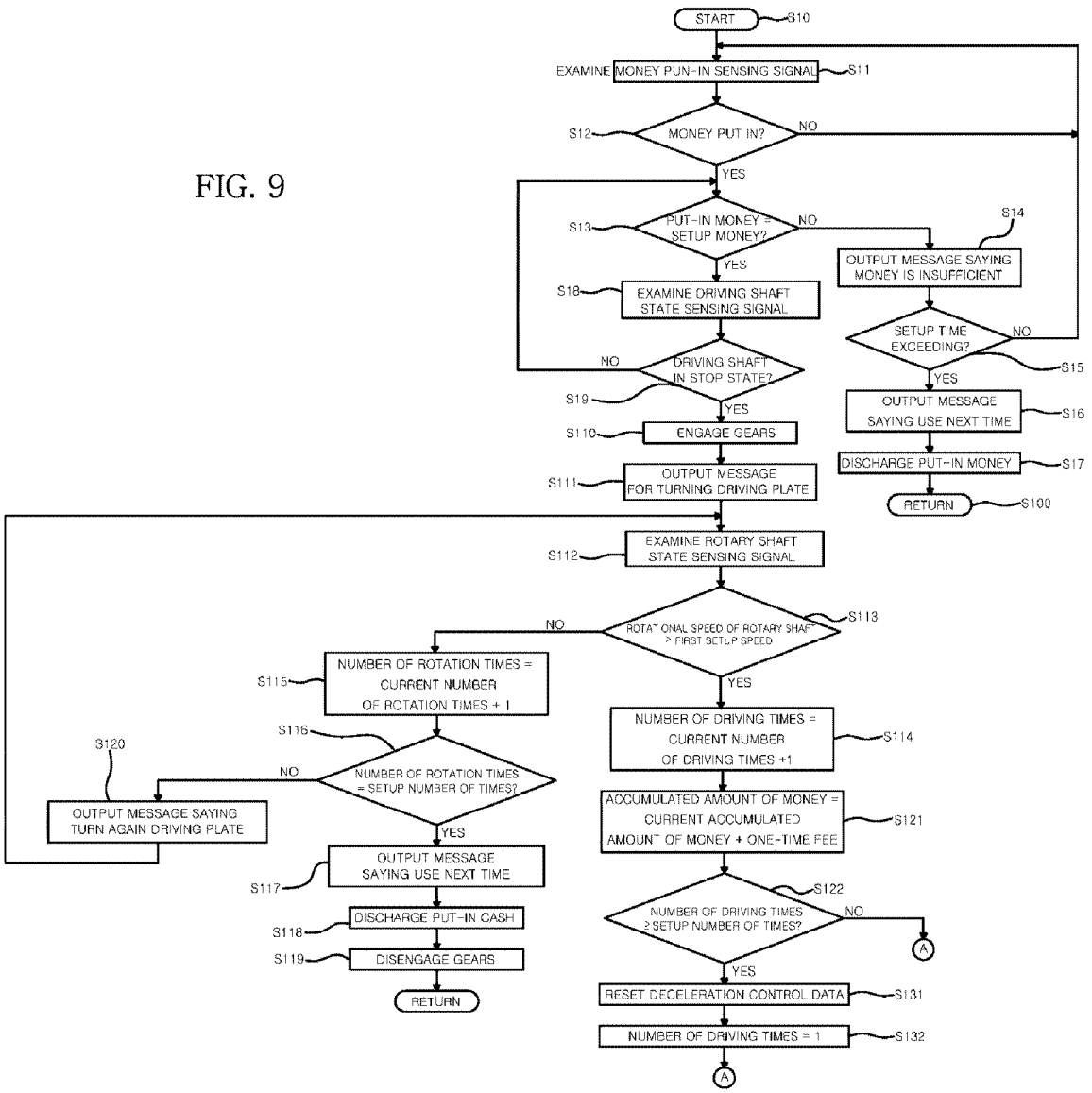
FIGS. 9 and 10 are flowcharts illustrating a method of driving a probabilistic vending machine according to an embodiment.
Figure 10:
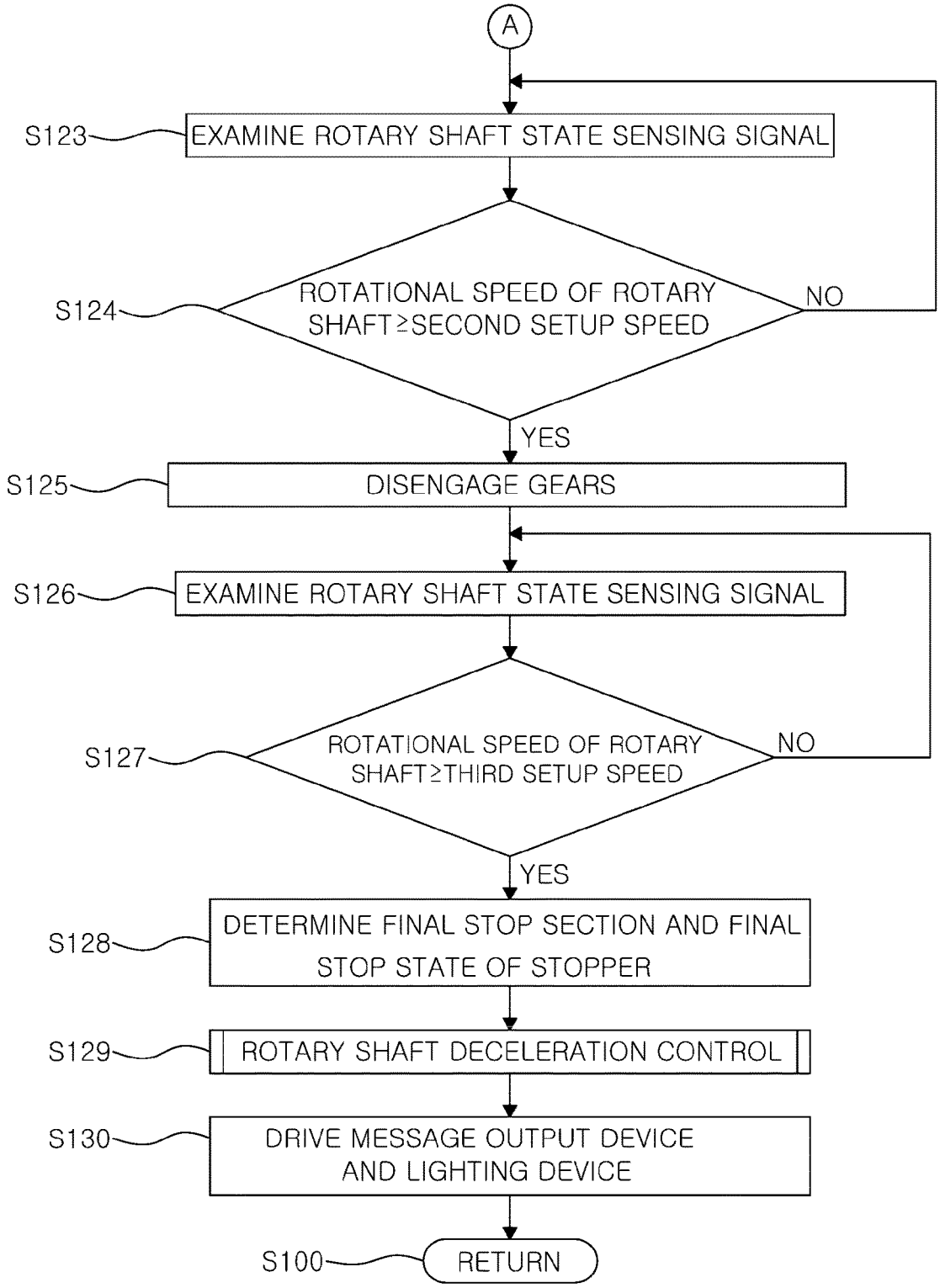

Next, a method of driving a probabilistic vending machine is described with reference to FIGS. 9 to 11. As a roulette unit driving device in the machine, the roulette unit driving device shown in FIGS. 2 to 3 is exemplified, but the roulette unit driving device shown in FIGS. 4 to 7 may be used in the same way.

First, the operation of outputting a product from a probabilistic vending machine operated by a user is described with reference to FIGS. 9 and 10.

When power for operating the probabilistic vending machine is supplied and the control unit 20 starts to operate (S10), the controller 21 of the control unit 20 determines whether money has been put into the slot 111 (S12) by examining a money input signal from the money sensing unit 11 (S11).

When it is determined that money has not been put into the slot 111, the controller 21 proceeds to the step S11 and determines whether cash has been put into the slot 111.

However, when it is determined that money has been put into the slot 111, the controller 21 determines whether the money put into the slot 111 is equal to the one-time fee of the probabilistic vending machine (S13).

When the put-in money is less than the fee, the controller 21 outputs a message through the message output device 33 (S14) indicating that the money is insufficient.

The character output unit 331 and the voice output unit 332 of the message output device 33 output the message set by the controller 21 using characters and a voice to inform the user of the probabilistic vending machine.

Next, it determines whether the time after determining that money has been put into the slot 111 in the step S12 exceeds a predetermined setup time (S15).

When the time has not exceeded the setup time, the controller 21 proceeds to the step S11 and determines whether money has been additionally put into the slot.

However, when it is determined that the time has exceeded a first setup time, the controller 21 outputs a message saying 'use next time' through the character output unit 331 and the voice output unit 332 of the message output device 33 (S16), thereby informing the user of the probabilistic vending machine. When money that is a portion of the fee is put into the slot 111 and then the remaining required amount is not put into it, the user cannot use the probabilistic vending machine.

Next, the controller 21 returns the money put in the slot 111 by operating a money return device (not shown) of the probabilistic vending machine (S17) and then returns to the initial state (S100).

As described above, when some of one-time fee of the probabilistic vending machine is put into the slot 111 and then the remaining required amount of the fee is not put into the slot 111 within a predetermined time, the user is stopped from using the probabilistic vending machine. The waiting time of the next user is reduced, so convenience of users is improved and the number of times the probabilistic vending machine can be used increases.

However, when the money determined in the step S13 is equal to the setup amount of money, that is, when one-time fee of the probabilistic vending machine is inserted into the slot 111, the controller 21 determines whether the driving shaft L1 is in a stop state (S19) by examining a driving shaft sensing signal from the driving shaft state sensing unit 12 (S18).

When it is determined that the driving shaft L1 is in the stop state on the basis of the sensing signal from the driving shaft state sensing unit 12, the controller 21 outputs a driving signal to the gear control motor 31 and the second transfer gear G3 on the driving shaft L1 and the third transfer gear G4 on the rotary shaft L2 are engaged with each other (S110).

That is, the gear control motor 31 is moved to a predetermined amount and rotated to a predetermined amount in a predetermined direction by the controller 21, and as in (a) of FIG. 3, the moving pin 5061 connected to the gear control motor 31 moves right.

As the moving pin 5061 moves, the springs 5063 and 5064 extend and the second transfer gear G3 is pushed right by the extension force of the spring 5064, so the second gear G3 engages with the third transfer gear G4 on the rotary shaft L2 above it.

As described above, when the transfer gears G3 and G4 on the driving shaft L1 and the rotary shaft L2 spaced from each other are engaged with each other by the operation of the gear control motor 31, the controller 21 outputs a guide message 'turn the driving plate' to the user through the character output unit 331 and the voice output unit 332 (S111).

However, when the driving shaft L1 is not in the stop state in the step S19, the controller 21 proceeds to the step S18 and determines whether the driving shaft L1 is in the stop state.

As described above, the transfer gears G3 and G4 are engaged with each other with the driving shaft L1 in the stop state, so shock or noise due to engagement is prevented.

However, when the driving shaft state sensing unit 12 is not provided, the operation in the steps S18 and S19 is omitted.

As described above, the two transfer gears G3 and G4 are engaged with each other by the operation of the gear control motor 31, and then the controller 21 determines whether the rotational speed of the rotary shaft L2 has reached a first setup speed (S113) by examining a sensing signal from the rotary shaft state sensing unit 13 (S112).

In the step S111, when the user holds a pin 5011 on the driving plate 501 and turns the driving plate 501 in a desired direction (for example, clockwise or counterclockwise) in accordance with the guide message 'turn the driving plate', torque from the driving plate 501 is transmitted to the driving gear G1 and to the first transfer gear G2 engaged with the driving gear G1, so the driving shaft L1 rotates with the turn of the driving plate 501. The rotational direction of the driving shaft L1 depends on the rotational direction of the driving plate 501.

As described above, even though the driving plate 501 is turned, the fixed plate L3 is not rotated by the bearing B1.

As described above, as the driving shaft L1 rotates with the turn of the driving plate 501, the second transfer gear G3 connected with the driving shaft L1 rotates and torque from the driving shaft L1 is transmitted to the third transfer gear G4 engaged with the second transfer gear G3.

The rotary shaft L2 starts to rotate and the rotary plate 503 fixed on the rotary shaft L2 starts to rotate. When the rotary shaft L2 rotates, torque from the rotary shaft L2 is transmitted to the rotary shaft deceleration motor 32 through the belt 5074, so the rotary shaft deceleration motor 32 is also rotated by the rotary shaft L2.

In this process, the fixed plate 502 keeps fixed without rotating even with the rotary shaft L2 rotating, by the bearing B7 between the rotary shaft L2 and the fixed plate 502.

When the rotational speed of the rotary shaft L2 determined in the step S113 reaches the first setup speed, the controller 21 updates the number of driving times by adding '1' to the current number of driving times stored in the memory 222 and stores the updated number of driving times back into the memory 222 (S114).

Since the rotary plate 503 is protected by the shield 504, the user or people around cannot freely manipulate the rotary plate 503 to increase or decrease the rotational speed thereof.

However, when the rotational speed of the rotary shaft L2 determined in the step S113 does not reach the first setup speed, the controller 21 updates the number of rotation times by increasing the number of rotation times of the driving plate 501 after the one-time fee is put into the machine by '1', and stores it in the memory 222 (S115).

The defaults of the numbers of driving times and rotation times are '0' in this embodiment.

Next, it determines whether the newly updated number of rotation times has reached a setup number of rotation times (S116).

When the number of rotation times of the driving shaft 501 reaches the setup number of rotation times, the controller 21 restricts the user using the probabilistic vending machine by outputting a message 'Use next time' through the character output unit 331 and the voice output unit 332 (S117) and operates the money return device, thereby discharging the money for the one-time fee through the slot 111 (S118).

Next, the controller 21 disengages the transfer gears G3 and G4 by operating the gear control motor 31 (S119) and returns to the initial state (S100).

As in (b) of FIG. 3, as the gear control motor 31 operates and pushes the moving pin 5061 to the left, the spring 5063 is compressed and the moving plate 5062 being in contact with the second transfer gear G3 also contracts the spring 5063 and moves left, so the second transfer gear G2 is pushed left. The second and third transfer gears G3 and G4 being in mesh are disengaged.

However, when the number of rotation times of the driving plate 501 does not reaches the setup number of times, the controller 21 outputs a message 'turn the driving plate again over setup speed' though the character output unit 331 and the voice output unit 332 (S120).

Next, it proceeds to the step S112 and determines the rotational speed of the rotary shaft L2 on the basis of an output signal from the rotary shaft state sensing unit 13.

As described above, when a user paying the one-time fee operates the driving plate 501 to start the probabilistic vending machine, if the user continuously turns the driving plate 501 less than the setup speed for a setup number of times (for example, three times), the user is stopped from using the probabilistic vending machine and the next uses gets a chance to use it.

Users are prevented from freely stopping the stopper in a desired one of the sections D1~Dn on the rotary plate 503 using accumulated skills and rotational speed of the rotary plate 503 increases user interest and reliability.

However, when the rotational speed of the rotary shaft is over the first setup speed in the step S113, the controller 21, as described above, updates the number of driving times stored in the memory 222 by adding '1' to the current number of driving times stored in the memory 22, that is, the number of times the probabilistic vending machine (S114) has been driven, and updates the accumulated amount of money by adding the one-time fee to the current accumulate amount of money stored in the memory 222 (S121). The controller 21 may also store the use date and the use time of the probabilistic vending machine with the accumulated amount of money in the memory 222.

Next, the controller 21 determines whether the number of driving times updated in the step S114 has reached the setup number of driving times (S122).

When it is determined that the number of driving times of the driving plate has not reached the setup number of times, the controller 21 determines whether the rotational speed of the rotary shaft L2 has decreased to a second setup speed on the basis of a sensing signal from the rotary shaft state sensing unit 13 (S123 and S124).

The second setup speed is smaller than the first setup speed.

As described above, since the section separation pins 5031 are disposed between adjacent two sections in the divided sections D1~Dn on the rotary plate 503, when the rotary plate 503 rotates, the section separation pins 5031 are moved by the rotation of the rotary plate 503 and hit against the stopper 5022.

Every time the section separation pins 5031 hit the stopper 5022, resistance that has an adverse influence on the torque of the rotary plate 503 is applied to the rotary plate 503 and a specific torque for additionally rotating the rotary shaft L2 is not applied from the outside, so the torque of the rotary shaft L2 is naturally reduced by friction of the components, as time passes. The rotational speed of the rotary shaft L2 gradually reduces after a user turns the driving plate 503.

As described above, when the rotational speed of the rotary shaft L2 reaches the second setup speed, the controller 21 disengages the transfer gears G3 and G4 being in mesh with each other, as described above with reference to (b) of FIG. 3, by controlling the gear control motor 31 (S125).

As described above, when the rotary shaft L2 is separated from the driving shaft L1, the rotary shaft L2 rotates independently from the rotation of the driving shaft L1, and as described above, the rotational speed of the rotary shaft L2 naturally decreases.

Next, the controller 21 determines again whether the rotational speed of the rotary shaft L2 has reduced to a third setup speed (S127) by examining a sensing signal from the rotary shaft state sensing unit 13 (S126).

When it is determined that the rotational speed of the rotary shaft L2 has reduced to the third setup speed, the controller 21 determines the final stop section of the stopper 5022 and the final stop state of the stopper 5022 corresponding to the current number of driving times, using data in the look-up table 221 (S128).

As described above, the final stop section and the final stop state of the stopper 5022 depend on the number of driving times of the driving plate 501.

Next, the controller 21 performs rotary shaft deceleration control on the basis of the current position of the stopper 5022 (hereafter, referred to as 'current stopper position) [that is, section where the stopper 5022 is positioned at the point of time of determining], the final stop section, and the final stop state (S129).

The stopper 5022 stops at a section determined in advance in accordance with the current number or driving times of the probabilistic vending machine.

When the stopper 5022 is stopped at a predetermined section in a predetermined state by the rotary shaft deceleration control, the controller 21 operates the message output device 33 and the lighting device 34, using the data in the memory 222 of the storage 22 (S130).

Messages set to correspond to stop sections of the stopper 5022 are outputted through the character output unit 331 and the voice output unit 332 of the message output device 33 and the lighting device 34 operates to correspond to the stop sections of the stopper 5022, so users can enjoy the probabilistic vending machine more.

Next, the rotary shaft deceleration control by the controller 21 is described in detail with reference to FIG. 11.

Figure 11:
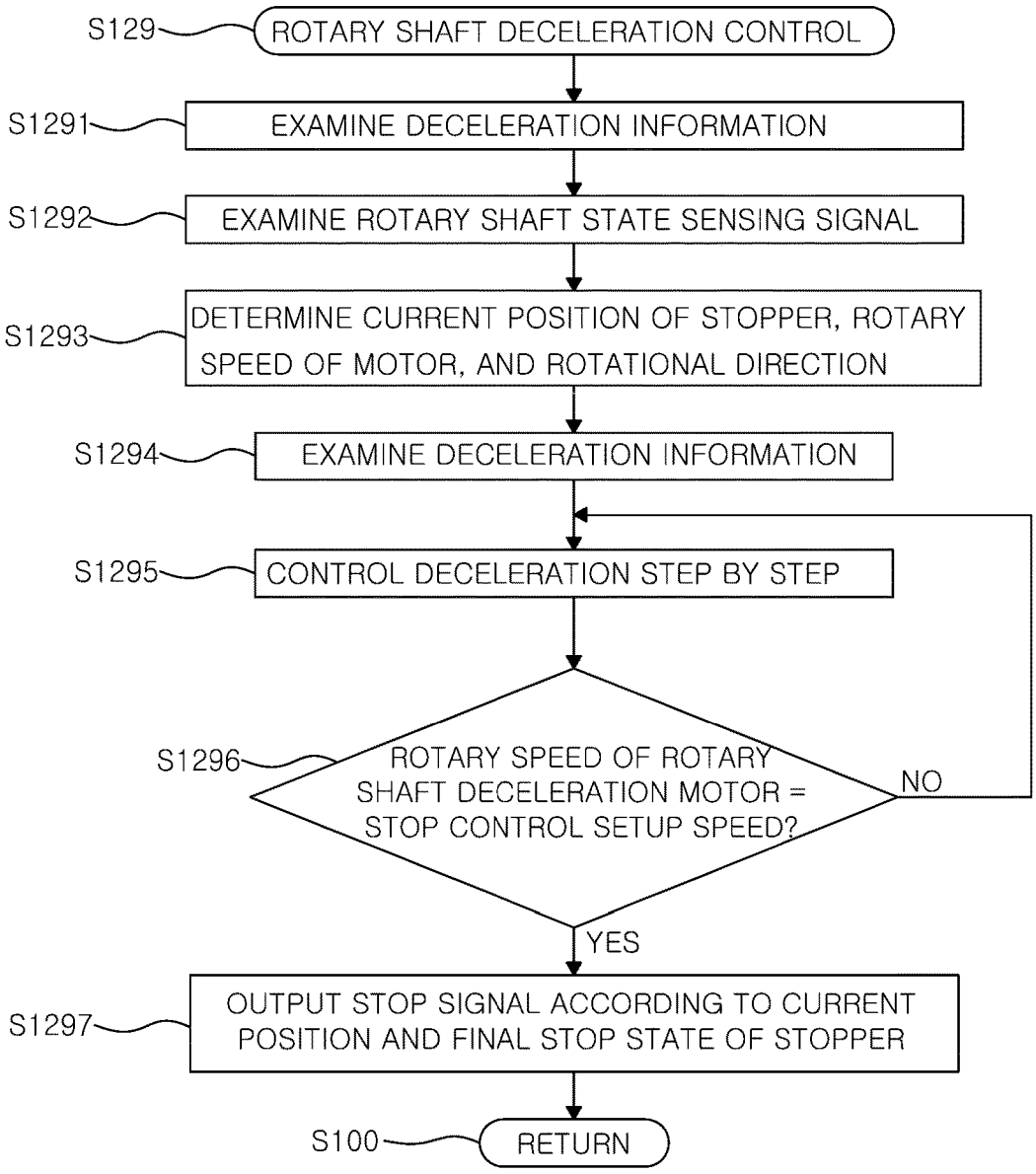
FIG. 11 is a flowchart illustrating a deceleration control routine in a probabilistic vending machine according to an embodiment.

As shown in FIG. 11, when the controller 21 enters a rotary shaft deceleration mode and performs the rotary shaft deceleration control (S129), the controller 21 reads out deceleration information for decelerating to the degree of deceleration determined in advance by a user and to the rotary speed of the rotary shaft deceleration motor 32 in each deceleration control step (S1291).

The degree of deceleration is the degree of deceleration of the rotary shaft deceleration motor 32 in equal speed deceleration and a desired degree of deceleration can be determined by a user through a selection switch (not shown). For example, it can be uniformly decelerated to 14.3 pulse/sec.

Further, in this embodiment, the deceleration control for stopping the stopper 5022 at the final stop section is performed through a plurality of steps (that is, a plurality of deceleration control steps) and the start point of the deceleration control steps is determined on the basis of the rotational speed of the rotary shaft deceleration motor 32.

Rotational speeds corresponding to the deceleration control steps are stored in advance in the memory 222.

It is possible to change, if necessary, the number of the deceleration control steps and the rotational speeds of the rotary shaft deceleration motor 32 corresponding to the deceleration control steps and it is also possible to change the degree of deceleration of the rotary shaft deceleration motor 32.

Next, the controller 21 determines the rotational direction of the rotary shaft L2 and the rotational speed of the rotary shaft L2 [that is, the rotary speed of the rotary shaft deceleration motor 32] (S1293) by examining an output signal from the rotary shaft state sensing unit 13 (S1292).

When determined the rotational speed of the rotary shaft deceleration motor 32 reaches a deceleration control start point, the controller 21 decelerates the rotary shaft deceleration motor 32 to a desired rotational speed by uniformly decelerating the rotary shaft deceleration motor 32 to a predetermined degree of deceleration, that is, decreasing the speed of the motor 32 to the same deceleration speed (S1294~S1296).

Next, an example of deceleration control is described with reference to FIG. 12.

Figure 12:
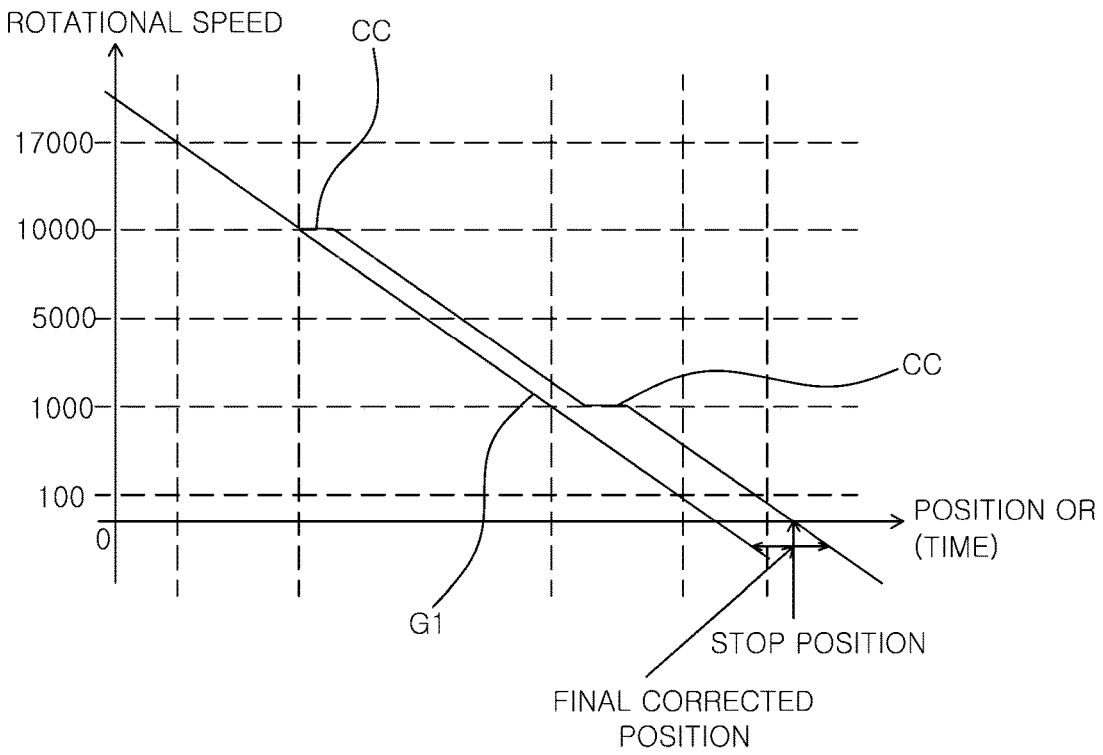
FIG. 12 is a view illustrating a deceleration control signal for reducing the rotational speed of a stopper in the deceleration control routine in a probabilistic vending machine according to an embodiment.

Referring to FIG. 12, a deceleration control steps is divided into four parts, in which an equal speed deceleration degree is 14.3 pulse/sec.

First, when the determined rotational speed of the rotary shaft deceleration motor 32 reaches a setup speed in a first deceleration control step, 17,000 pulse/sec, the controller 21 uniformly decelerates the rotary shaft deceleration motor 32 at a predetermined deceleration degree.

When the rotational speed of the rotary shaft deceleration motor 32 reaches 10,000 pulse/sec that is a setup speed in a second deceleration step by the decelerating, the controller 21 determines whether the stopper is positioned now in the final stop section (for example, section No. 10).

When the stopper is now positioned in the final stop section, the controller 21 uniformly decreases again the rotational speed of the rotary shaft deceleration motor 32 to a predetermined deceleration degree.

However, when the stopper is now not in the final stop section, the controller 21 controls the operation of the rotary shaft deceleration motor 32 so that it rotates at a constant speed by stopping deceleration control on the rotary shaft deceleration motor 32. The equal speed control (CC) is performed until the stopper reaches the final stop section.

When the stopper is positioned now in the final stop section, the controller 21 uniformly decreases again the rotational speed of the rotary shaft deceleration motor 32 with a predetermined deceleration degree until a setup speed (for example, 5,000 pulse/sec) in a third deceleration step is reached.

Similar to the second deceleration control step, equal speed deceleration is performed in the third deceleration control step in accordance with whether the stopper is now in the final stop section, and then deceleration control may be uniformly performed again to a fourth deceleration control step (for example, 1,000 pulse/sec) or deceleration control may be performed without equal speed control.

In FIG. 12, a graph 'G1' is a graph when uniform deceleration control was performed without equal speed control.

The rotational speed of the rotary shaft deceleration motor 32 is decelerated step by step in this way (S1295).

The controller 21 already knows the rotational direction of the rotary shaft L2 in the step S1293, so it controls the rotational direction of the rotary shaft deceleration motor 32 to be the same as the rotational direction of the rotary shaft L2 in deceleration control.

When deceleration control is performed on the rotary shaft through the deceleration control steps and it is determined that the rotational speed of the rotary shaft deceleration motor 32 has reached a stop control setup speed (100 pulse/sec in FIG. 12) by deceleration control after the fourth deceleration control step, the controller 21 outputs a stop signal for stopping the rotation of the rotary shaft deceleration motor 32 on the basis of the difference between the current position of the stopper and the final stop state (S1297).

The state of the stop signal, that is, the number of stop pulses applied to the rotary shaft deceleration motor 32 to stop the rotation of the rotary shaft deceleration motor 32 depends on the difference between the current position of the stopper 5022 and the final stop state.

The stopper 5022 stops in the final stop state at a predetermined final stop section.

Next, the final stop state of the stopper 5022 is described with reference to FIGS. 13 to 15.

Figure 13:
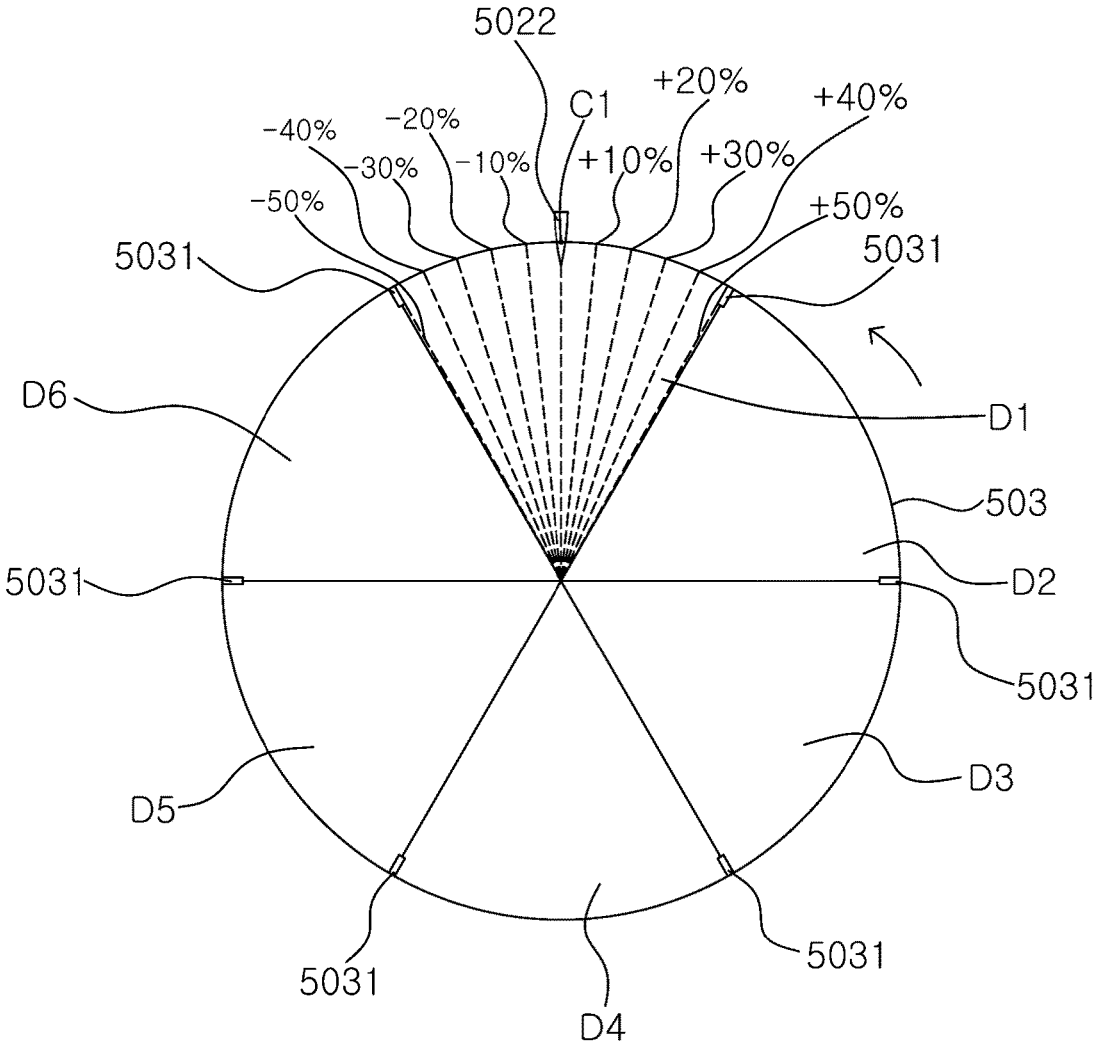
FIGS. 13 to 15 are views illustrating a stop state of a stopper at divided sections of a rotary plate in a probabilistic vending machine according to an embodiment, in which FIG. 13 numerically shows the degree of deviation of the stopper from a stop position.
Figure 14:
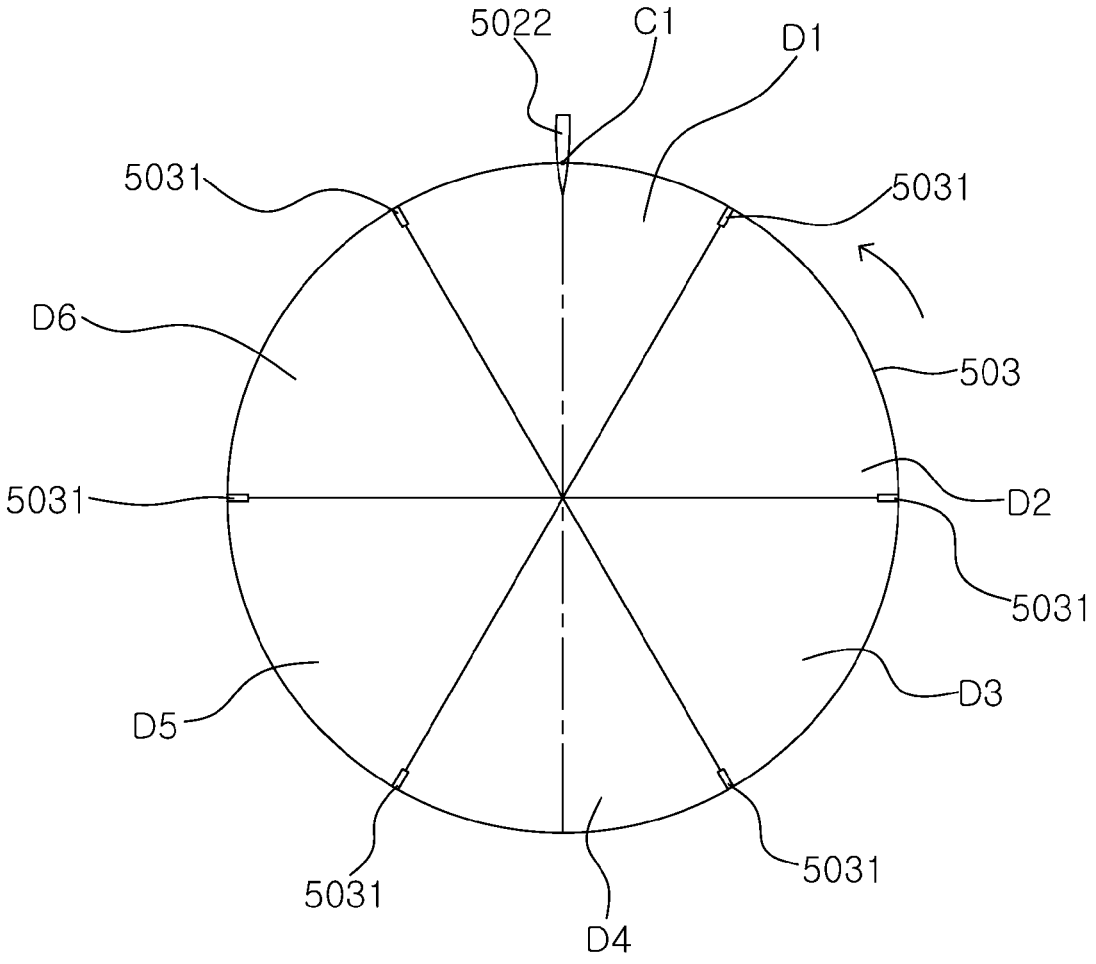
Figure 15:
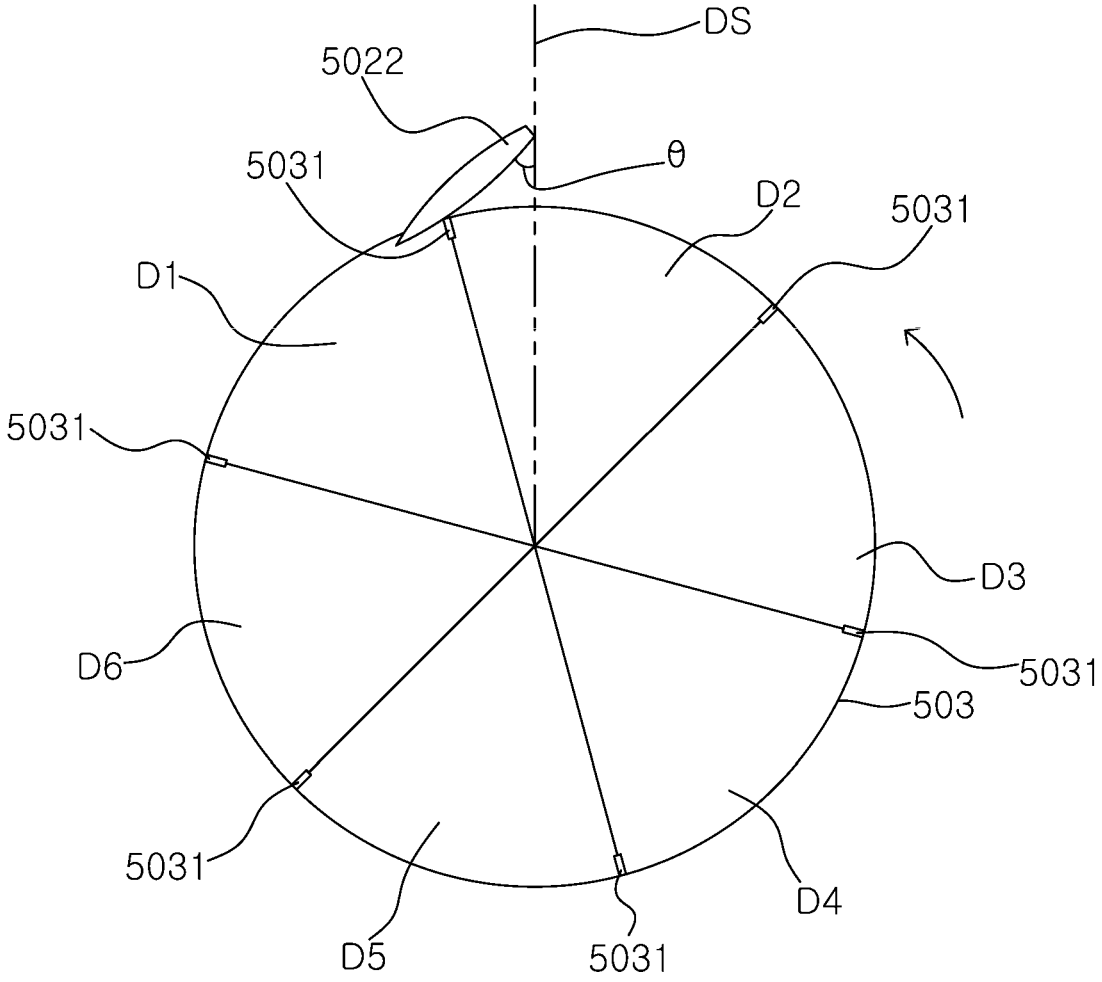

In FIGS. 13 to 15, the rotary plate 503 rotates counterclockwise, as an example. The number of a plurality of divided sections D1~Dn on the rotary plate 503 is six in FIGS. 13 to 15.

The final stop state of the stopper 5022 is divided, as shown in FIGS. 13 to 15, into a case when the stopper 5022 is positioned in a section where it keeps vertical (that is, makes 90 degrees with the ground) (hereafter, referred to as a 'stopper-vertical section') and a case when the stopper 5022 is inclined at an angle larger 0 degree (hereafter, referred to as a 'stopper-inclined section'), that is, when the angle θ (hereafter, referred to as a 'stopper-inclined angle') made by the stopper 5022 and a virtual surface DS making 90 degree with the ground is 0 degree or more.

The case when the stopper 5022 is positioned in the stopper-vertical section is divided into a case when the center portion C1 of the outer side passes the stopper 5022 while rotating in a predetermined direction, a case when it is positioned before the stopper 5022, and a case when the stop position of the stopper 5022 and the position the center portion C1 is substantially the same.

For example, as shown in FIG. 13, in the stopper-vertical section, assuming that the degree that the center portion C1 of the sections D1~Dn deviate from the stop position of the stopper 5022 (deviation degree) is maximum 50% in a positive (+) or a negative (−) direction, the deviation degree is 0% when the stop position of the stopper 5022 and the position of the center portions C1 are the same (for example, FIG. 14), and the case when it deviates maximally (50%) in the positive (+) direction or the negative direction (−) is the case when the section separation pin 5031 between a corresponding section (for example, D1) and a section D2 adjacent to the section D1 and the stopper 5022 are in contact with each other (for example, FIG. 15).

The terms 'positive (+)' and 'negative (−)' show the position of the center portion C1 relative to the stopper 5022. The term 'positive (+)' means that the center portion C1 has passed the stopper 5022, and the term 'negative (−)' means that the center portion C1 has not passed the stopper 5022 yet. When the rotary plate 503 rotates clockwise, opposite to FIG. 13 and when the center portion C1 is positioned at the same point as FIG. 13, the symbols (+ and d−) are opposite.

In the stopper-inclined section, as described above, the stopper-inclined angle θ is 0 degrees or more, and the maximum angle, that is, the angle made right before the stopper 5022 moves into the next adjacent sections D1~Dn depends on the length of the stopper 5022 and the width of the section separation pins 5031.

As described above, the final stop state of the stopper 5022 determined in accordance with the number of driving times of the driving plate 501 is positioned not only in the stopper-vertical section, but the stopper-inclined section, and the deviation degree and the stopper-inclined angle θ in the stopper-vertical section are variously defined in accordance with the number of driving times, so it is possible to improve user interest.

Next, for example, the final stop sections and the final stop states of the stopper 5022 from the first rotation to the tenth rotation are shown in Table 1, in which the divided sections of the rotary plate 503 may be, for example, twelve.

TABLE 1

| Number of driving times of driving plate | Final stop section of stopper | Final stop state of stopper |
|---|---|---|
| 1 | section No. 3 | 0% |
| 2 | section No. 6 | −30% |
| 3 | section No. 7 | −5% |
| 4 | section No. 1 | +50% |
| 5 | section No. 10 | −10% |
| 6 | section No. 11 | +5% |
| 7 | section No. 8 | 0% |
| 8 | section No. 2 | +15% |
| 9 | section No. 12 | −25% |
| 10 | section No. 1 | −10% |

As described above, since the final stop position of the stopper 5022 is determined in advance in accordance with the number of driving times, the average number of times of discharging products or the ratio of winning products is controlled by the manager of the probabilistic vending machine. Products are not discharged too much or too less, which prevents user interest from declining and prevents economical loss of the manager, so both users and the manager can be satisfied.

Further, since the deceleration control state (for example, the number of deceleration control steps and each deceleration degree) is determined in advance in accordance with the current rotational state of the rotary shaft L2, that is, the rotational state of the rotary plate 503, even though deceleration of the rotary plate 503 through the rotary shaft deceleration motor 32 is artificially controlled, a user of the probabilistic vending machine feels like the rotary plate 503 naturally decelerates and stops. Accordingly, user interest is increased.

However, when the number of driving times reaches a setup number of times in the step S122, the controller 21 resets the data in the look-up table 221 and deceleration control data such as deceleration information kept in the memory 222 for controlling the operation of the probabilistic vending machine (S131) and then sets the number of driving times to '1' and stores it in the memory 222. Deceleration control of the probabilistic vending machine is performed in accordance with the reset deceleration control data. The deceleration information may be the same as or different from the previous information.

When the number of driving times of the probabilistic vending machine reaches a setup number of times (for example, 500 times), the deceleration control data is changed, and the final stop section and the final stop state of the stopper 5022 according to the number of driving times is changed accordingly, so a user is prevented from selecting the final stop section by changing the driving order.

When the number of driving times of the probabilistic vending machine reaches a setup number of times (for example, 500 times), the controller 21 can inform the manager of the reset state of the deceleration control data by outputting the state showing that the number of driving times has reached the setup number of times to the management server 70 through the message output device 30 or the communication unit 23 and the communication network 50. When the setup number of times is reached, the controller 21 can randomly and newly create and apply a probability table on the basis of rules defined in advance (for example, 3 times for first grade, 10 times for second grade, and 50 times for third grade in 500 times).

In this case, the manager can increase users interest by replacing the rotary plate 5022 with product names or the number of products to be discharged on the sections D1~Dn, with a new one.

Figure 16:
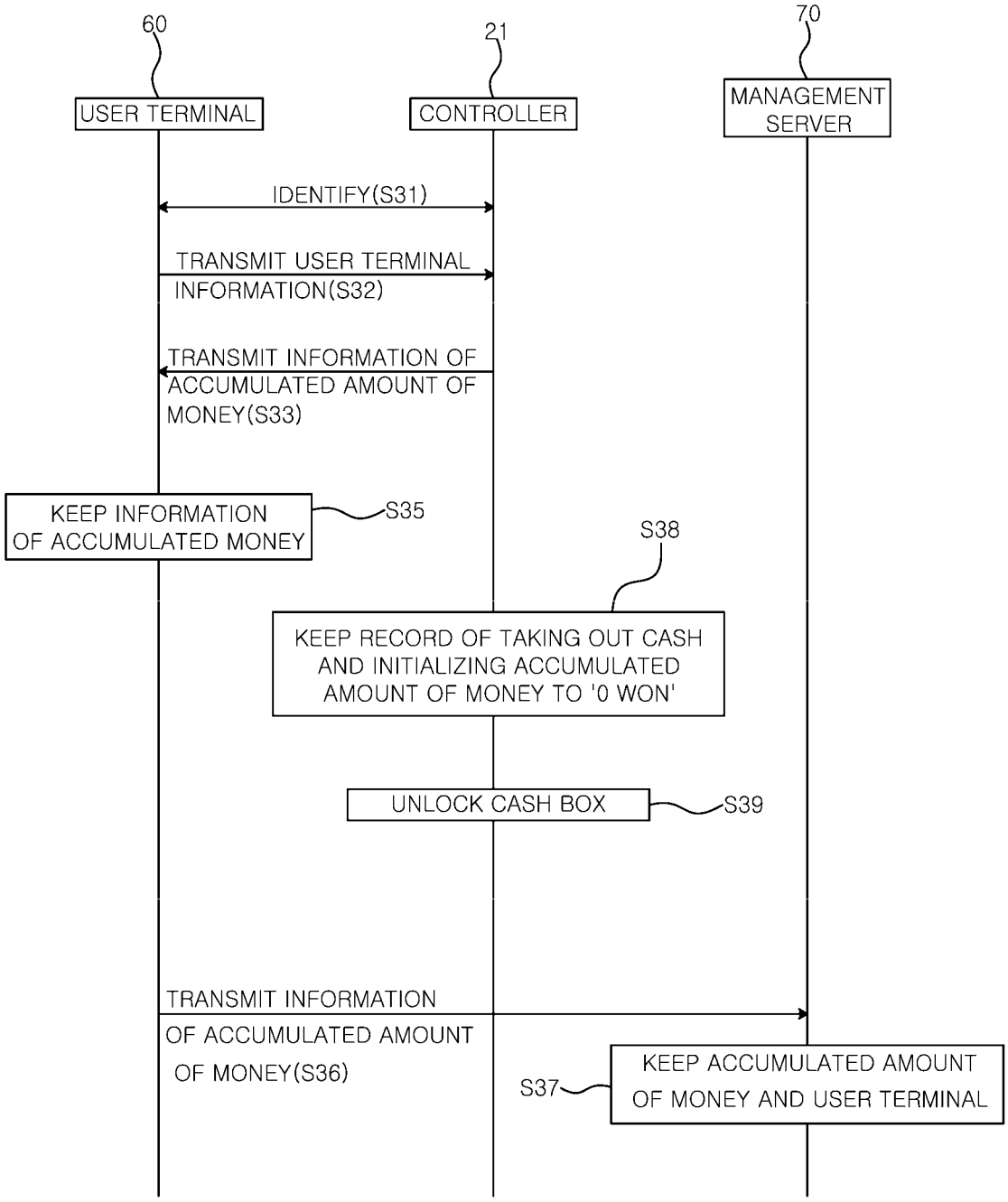
FIG. 16 is a flowchart illustrating a cash box-unlocking routine in a probabilistic vending machine according to an embodiment of the present disclosure.

Next, controlling a cash box locking device by means of the controller 21 is described with reference to FIG. 16.

First, in order to take the money for the fee accumulated in a cash box in the probabilistic vending machine, the user terminal 60 and the controller 21 each have an identification symmetric key and an application for interactive identification with the controller 21 is installed in the user terminal 60.

Communication between the user terminal 60 and the controller 21 may be made by Bluetooth or a non-contact smart card interface type and communication between the user terminal 60 and the management server 70 may be made by 3G, LTE, or Wi-Fi.

First, the user terminal 60 and the controller 21 identify each other, using the identification symmetric keys (S31).

Next, when the user terminal 60 and the controller 21 finish identifying each other, the user terminal 60 creates information about the user terminal 60 and transmits it to the controller 21 (S32).

The information on the user terminal 60 may be a phone number and time and is encoded and then transmitted to the controller 21. The controller 21 decodes and examines the information and keeps it in a storage such as the memory 222.

As described above, when the controller 21 receives the information about the user terminal 60, it encodes information about the currently accumulated amount of money for the fee and transmits it to the user terminal 60.

When the user terminal 60 receives the information about the accumulated amount of money from the controller 21, it keeps the transmitted information about the accumulated amount of money in a memory therein (not shown) (S34). Since the information about the accumulated amount of money has been encoded, the user of the user terminal 60 cannot see the accumulated amount of money transmitted from the controller 21.

The user terminal 60 keeping the accumulated amount of money encodes the accumulated amount of money and the information about the user terminal 60 and then transmits them to the management server 70 (S36). Since the information of the accumulated amount of money is transmitted after being encoded, if the transmission fails, the accumulated amount of money does not leak to the outside.

The accumulated amount of money may include not only the accumulated amount of money for the fee, but use details including use dates and use time of the probabilistic vending machine.

The management server 70 receiving the information of accumulated amount of money from the user terminal 60 decodes the encoded information of the accumulated amount of money and information about the user terminal 60 and keeps them in a database (S37).

The management server 70 can know the amount of money and the person who took out the money, so it can compare the actually taken-out amount of money with the kept amount of money, thereby preventing a financial accident.

Further, the controller transmitting the information about the accumulated amount of money to the user terminal 60 keeps the records of taking out cash, that is, the amount of money taken for the fee, the reception dates and time in the memory 222 and the initializes the accumulated amount of money to '0 Won' (S38). Next, the controller 21 unlocks the cash box by sending a control signal to the cash box locking device 36 so that the user of the user terminal 60, who is the person to take out money, can take out the money in the cash box. The person can take the money for the fees that are in the cash box of the probabilistic vending machine.

Since the person knows that the information of the accumulated amount of money for the fee to be taken out is transmitted to the management server 70, it is possible to prevent some of the money in the cash box from being embezzled or lost by the person.

Therefore, the cash box is not abnormally opened, so probability of an accident such as a robbery decreases.

Although exemplary embodiments of the present disclosure were described in detail above, the scope of the present disclosure is not limited thereto and various changes and modifications from the spirit of the present disclosure defined in the following claims by those skilled in the art are also included in the scope of the present disclosure.

The invention claimed is:

1. A probabilistic vending machine comprising:

a fixed shaft having an empty space in a center and extending in a first direction;

a fixed plate connected with the fixed shaft and having a stopper;

a driving gear connected with the fixed shaft;

a driving plate connected with the driving gear and rotating in a first rotational direction or a second rotational direction opposite to the first rotational direction;

a first transfer gear connected with the driving gear;

a driving shaft connected with the first transfer gear;

a rotary shaft disposed in the empty space of the fixed shaft and extending in the first direction;

a rotary plate connected with rotary shaft;

a second transfer gear connected to the driving shaft;

a third transfer gear connected to the rotary shaft to correspond to the second transfer gear;

a gear control mechanism moving the driving shaft in the first direction; and a rotary shaft deceleration mechanism reducing a rotational speed of the rotary shaft.

2. The probabilistic vending machine of claim 1, wherein the gear control mechanism includes a gear control motor that rotates, and is moved straight in the first direction by operation of the gear control motor.

3. The probabilistic vending machine of claim 1, wherein the rotary shaft deceleration device includes a rotary shaft deceleration motor that rotates and a power transmission mechanism connected to the rotary shaft and transmits torque from the rotary shaft deceleration motor to the rotary shaft.

4. The probabilistic vending machine of claim 1, further comprising a plurality of supports spaced from each other in the first direction and supporting positions of the fixed shaft, the driving shaft, and the rotary shaft by passing through at least one of the fixed shaft, the driving shaft, and the rotary shaft.

5. The probabilistic vending machine of claim 1, further comprising a shield disposed on the fixed plate and covering the rotary plate.

6. The probabilistic vending machine of claim 1, further comprising a shield disposed on the driving plate and covering the driving plate.

7. A probabilistic vending machine comprising:

a first fixed shaft being a hollow shaft and extending in a first direction;

a driving gear connected with the first fixed shaft;

a driving plate connected with the driving gear and rotating in a first rotational direction or a second rotational direction opposite to the first rotational direction;

a rotary shaft being a hollow shaft, disposed inside the first fixed shaft, and extending in the first direction;

a rotary plate connected with the rotary shaft;

a second fixed shaft disposed inside the rotary plate and extending in the first direction;

a fixed plate connected to the second fixed shaft and having a stopper;

a first transfer gear connected with the driving gear;

a driving shaft connected with the first transfer gear;

a second transfer gear connected to the driving shaft;

a third transfer gear connected to the rotary shaft to correspond to the second transfer gear;

a gear control mechanism moving the driving shaft in the first direction; and a rotary shaft deceleration mechanism reducing a rotational speed of the rotary shaft.

8. The probabilistic vending machine of claim 7, wherein the gear control mechanism includes a gear control motor that rotates, and is moved straight in the first direction by operation of the gear control motor.

9. The probabilistic vending machine of claim 7, wherein the rotary shaft deceleration device includes a rotary shaft deceleration motor that rotates and a power transmission mechanism connected to the rotary shaft and transmits torque from the rotary shaft deceleration motor to the rotary shaft.

10. The probabilistic vending machine of claim 7, further comprising a plurality of supports spaced from each other in the first direction and supporting positions of the first and second fixed shafts, the driving shaft, and the rotary shaft by passing through at least one of the first and second fixed shaft, the driving shaft, and the rotary shaft.

11. The probabilistic vending machine of claim 7, further comprising a shield disposed on the fixed plate and covering the rotary shaft.

12. The probabilistic vending machine of claim 7, further comprising a shield disposed on the driving plate and covering the driving plate.

13. A probabilistic vending machine comprising:

a driving plate rotating in a first rotational direction or a second rotational direction opposite to the first rotational direction;

a driving shaft having an empty space in a center and extending in a first direction;

a driving gear connected with the driving shaft;

a fixed shaft extending in the first direction in the empty space of the driving shaft;

a rotary shaft disposed in an empty space of the fixed shaft and extending in the first direction;

a rotary plate connected with rotary shaft;

a fixed plate disposed on the fixed shaft and having a stopper;

a first gear connected with the driving shaft;

a second gear engaging with the first gear or disengaging from the first gear by moving in the first direction;

a third gear engaged with the second gear and connected with the rotary shaft;

a gear control mechanism moving the second gear in the first direction; and a rotary shaft deceleration mechanism reducing a rotational speed of the rotary shaft.

14. The probabilistic vending machine of claim 13, wherein the gear control mechanism includes a gear control motor that rotates, and is moved straight in the first direction by operation of the gear control motor.

15. The probabilistic vending machine of claim 13, wherein the rotary shaft deceleration device includes a rotary shaft deceleration motor that rotates and a power transmission mechanism connected to the rotary shaft and transmits torque from the rotary shaft deceleration motor to the rotary shaft.

16. The probabilistic vending machine of claim 13, further comprising a shield disposed on the driving plate and covering the driving plate.

17. A driving device of a probabilistic vending machine, comprising:

a rotary shaft state sensing unit sensing an operation state of a rotary shaft and outputting a signal showing a corresponding state;

a control unit connected with the rotary shaft state sensing unit;

a gear control motor connected to the control unit; and a rotary shaft deceleration motor connected to the control unit, wherein when a rotational speed of the rotary shaft determined on the basis of a rotary shaft state sensing signal outputted from the rotary shaft state sensing unit is a second setup speed or more, the control unit disengages a driving shaft and a rotary shaft from each other by operating the gear control motor, and when the rotational speed of the rotary shaft determined on the basis of a rotary shaft state sensing signal outputted from the rotary shaft state sensing unit is a third setup speed or more, the control unit controls deceleration state of the rotary shaft deceleration motor, using a current stopper position, a final stop section of the stopper, and a final stop state of the stopper.

18. The driving device of claim 17, wherein the final stop section and the final stop state of the stopper are determined in accordance with the number of driving times of the probabilistic vending machine.

19. The driving device of claim 17, wherein the control unit performs deceleration control with a predetermined deceleration degree of the rotary shaft motor in accordance with a change of the rotational speed of the rotary shaft.

20. The driving device of claim 17, wherein when the rotational speed of the rotary shaft determined on the basis of the rotary shaft state sensing signal outputted from the rotary shaft state sensing unit is a first setup speed or more, the control unit determines whether or not the rotational speed of the rotary shaft determined on the basis of a rotary shaft state sensing signal outputted from the rotary shaft state sensing unit is a second setup speed or more.

21. The driving device of claim 17, wherein when the rotational speed of the rotary shaft determined on the basis of the rotary shaft state sensing signal outputted from the rotary shaft state sensing unit is a first setup speed or more, the control unit increases the number of driving times by '1', and when the increased number of driving times is less than a setup number of driving times, the control unit determines whether or not the rotational speed of the rotary shaft determined on the basis of a rotary shaft state sensing signal outputted from the rotary shaft state sensing unit is a second setup speed or more.

22. The driving device of claim 17, wherein when the rotational speed of the rotary shaft determined on the basis of the rotary shaft state sensing signal outputted from the rotary shaft state sensing unit less than a first setup speed, the control unit increases the number of rotation times of a driving plate by '1', and when the increased number of rotation times of the driving shaft is a setup number of times or more, the control unit restricts a current user using the probabilistic vending machine.

23. The driving device of claim 22, wherein when the number of rotation times of the rotary shaft is a setup number of times or more, the control unit disengages the driving shaft and the rotary shaft from each other by operating the gear control motor.

24. The driving device of claim 17, further comprising a money sensing unit sensing whether money has been put into a slot and outputting a signal showing a corresponding state, wherein the control unit determines via the money sensing unit whether a predetermined amount of money has been put into the slot through, and when the money sensing unit senses the predetermined amount of money put in the slot, the control unit engages the rotary shaft and the driving shaft with each other by operating the gear control motor.

25. The driving device of claim 24, further comprising a driving shaft state sensing unit sensing an operation state of the driving shaft and outputting a signal showing a corresponding state, wherein when a speed of the driving shaft determined on the basis of a driving shaft state sensing signal outputted from the driving shaft state sensing unit is in a stop state, the control unit engages the rotary shaft and the driving shaft with each other by operating the gear control motor.

26. The driving device of claim 17, wherein when the rotational speed of the rotary shaft determined on the basis of the rotary shaft state sensing signal outputted from the rotary shaft state sensing unit is a first setup speed or more, the control unit increases an accumulated amount of money by a one-time fee and keeps the increased amount of money in a storage.

27. The driving device of claim 26, further comprising:

a communication unit communicating with a user terminal and a management server; and a cash box locking device connected with the control unit and controlling a locking state of a cash box in the probabilistic vending machine, wherein the control unit performs identification with the user terminal, and when the identification is finished, the control unit transmits the accumulated amount of money to a management server through the user terminal by transmitting the accumulated money for a fee to the user terminal through the communication unit, and unlocks the cash box locking device.

28. A method of driving a probabilistic vending machine, comprising:

determining whether a rotational speed of a rotary shaft is a second setup speed or more on the basis of a signal outputted from a rotary shaft state sensing unit;

disengaging a driving shaft and the rotary shaft from each other by operating a gear control motor, when the rotational speed of the rotary shaft is the second setup speed or more;

determining whether the rotational speed of the rotary shaft is a third setup speed or more on the basis of a signal outputted from the rotary shaft state sensing unit;

determining the number of driving times of a probabilistic vending machine, using data kept in a storage, when the rotational speed of the rotary shaft is the third setup speed or more;

determining a final stop section and a final stop state of a stopper corresponding to the determined number of driving times; and positioning the stopper to the final stop section in the final step state by reducing the rotational speed of the rotary shaft at a predetermined deceleration degree by operating a rotary shaft deceleration motor on the basis of the rotational speed of the rotary shaft.

29. The method of claim 28, further comprising:

determining money put into a slot on the basis of a signal outputted from a money sensing unit;

determining whether the money put in the slot is the same as a setup amount of money;

determining whether the driving shaft is in a stop state on the basis of a driving shaft state sensing signal, when the money put in the slot is the same as the setup amount of money; and engaging the driving shaft with the rotary shaft by operating a gear control motor, when the driving shaft is in a stop state.

30. The method of claim 28, further comprising:

determining whether time that has elapsed after money has been put in a slot exceeds a setup time, when the money put in the slot is not the same as a setup amount of money; and discharging the money, which has been put in the slot, through the slot when the time elapsed exceeds the setup time.

31. The method of claim 28, further comprising:

determining whether the rotational speed of the rotary shaft is a first setup speed or more on the basis of a signal outputted from a rotary shaft state sensing unit; and proceeding to determining whether the rotational speed of the rotary shaft is the second setup speed or more, after increasing the number of driving times of the probabilistic vending machine by '1' when the speed of the driving shaft is the first setup speed or more.

32. The method of claim 31, further comprising:

increasing the number of rotation times of a driving plate by '1', when the rotational speed of the rotary shaft is less tan the first setup speed;

determining whether the number of rotation times of the driving plate is the same as a setup number of times; and discharging a money put in a slot to the slot, when the number of rotation times of the driving plate is the same as the setup number of times.

33. The method of claim 28, further comprising:

determining whether the rotational speed of the rotary shaft is the first setup speed or more on the basis of a signal outputted from the rotary shaft state sensing unit; and increasing the accumulated amount of money by a one-time fee, when the rotational speed of the rotary shaft is the first setup speed or more.

34. The method of claim 33, further comprising:

performing identification with a user terminal;

transmitting information about the accumulated amount of money for a fee to the identified user terminal;

storing a record of taking out cash and then initializing the accumulated amount of money, after transmitting the information about the accumulated amount of money; and unlocking a cash box after transmitting the information about the accumulated amount of money.

* * * * *